United States Patent [19]

Izumi et al.

[11] Patent Number: 4,809,504

[45] Date of Patent: Mar. 7, 1989

[54] CONTROL SYSTEM FOR CONTROLLING INPUT POWER TO VARIABLE DISPLACEMENT HYDRAULIC PUMPS OF A HYDRAULIC SYSTEM

[75] Inventors: Eiki Izumi; Yasuo Tanaka, both of Ibaraki; Hiroshi Watanabe, Ushiku; Shigetaka Nakamura, Tsuchiura, all of Japan

[73] Assignee: Hitachi Construction Machinery Co., Ltd., Tokyo, Japan

[21] Appl. No.: 2,281

[22] Filed: Jan. 12, 1987

[30] Foreign Application Priority Data

Jan. 11, 1986 [JP] Japan ..... 61-2872
Jan. 11, 1986 [JP] Japan ..... 61-2873
Jan. 11, 1986 [JP] Japan ..... 61-2874

[51] Int. Cl.[4] ..... F04B 49/06; F16H 39/46

[52] U.S. Cl. ..... 60/430; 60/444; 60/449; 417/216

[58] Field of Search ..... 60/428, 430, 443, 444, 60/449, 452; 417/216, 218

[56] References Cited

U.S. PATENT DOCUMENTS 4,162,874 7/1979 Marietta ..... 60/428 X
4,395,199 7/1983 Izumi et al. ..... 60/449 X
4,510,750 4/1985 Izumi et al. ..... 60/443
4,518,321 5/1985 Schniederjan ..... 60/452 X
4,528,813 7/1985 Izumi et al. ..... 60/444 X
4,561,250 12/1985 Aoyagi et al. ..... 60/449 X
4,586,330 5/1986 Watanabe et al. ..... 60/428 X
4,606,313 8/1986 Izumi et al. ..... 123/357 X
4,655,689 4/1987 Westveer et al. ..... 60/449 X
4,689,956 9/1987 Hein ..... 60/449

FOREIGN PATENT DOCUMENTS 143180 9/1982 Japan ..... 60/444
161303 10/1982 Japan ..... 60/443
8001400 7/1980 PCT Int'l Appl. ..... 60/443

*Primary Examiner*—Edward K. Look
*Assistant Examiner*—George Kapsalas
*Attorney, Agent, or Firm*—Antonelli, Terry & Wands

[57] ABSTRACT

A control system for controlling input power to hydraulic pumps of a hydraulic system including a prime mover and a plurality of variable displacement hydraulic pumps driven by said prime mover. The control system comprises: a first computing unit for computing, for each of the hydraulic pumps, an input torque control value concerning a distribution of input torques of said hydraulic pumps from a representative pressure obtained on the basis of a discharge pressure of at least one other hydraulic pumps; a second computing unit for determining an input torque for each of the hydraulic pumps on the basis of a corresponding one of the input torque control values determined by the first computing unit; and a third computing unit for determining an object discharge rate of each of the hydraulic pumps from the input torque obtained by the second computing unit and an own discharge pressure of each of the hydraulic pumps.

20 Claims, 15 Drawing Sheets

CONTROL SYSTEM FOR CONTROLLING INPUT POWER TO VARIABLE DISPLACEMENT HYDRAULIC PUMPS OF A HYDRAULIC SYSTEM

BACKGROUND OF THE INVENTION

1. Field of the Invention

The invention relates to a control system for controlling input power to hydraulic pumps of a hydraulic driving system including a prime mover and a plurality of variable displacement hydraulic pumps driven by the prime mover and, more particularly, to a control system for controlling input power to hydraulic pumps of the hydraulic driving system in which the discharge rate of the variable displacement hydraulic pumps driven by the prime mover are controlled by means of solenoid valves by detecting tilting angles of the swash plates of the pumps and the discharge pressure of the pumps.

2. Description of the Prior Art

Heretofore, control systems of the type described hereinabove are known, for example, the control system disclosed in Japanese Patent Application No. 55-14049 of which corresponding patent applications are U.S. Ser. No. 387,884 (granted as U.S. Pat. No. 4,606,313), EPC Patent Application No. 81902759.0 and Korea Patent Application No. 3829/1981. This control system is adapted to control the input power to the pumps in such a manner that a difference in the rotational speed between an object rotational speed of the engine determined by the operation amount of the accelerator and the actual output rotational speed, namely, a deviation of the rotational speed is detected and object values of the tilting angle of the swash plates of the hydraulic pumps are calculated from the deviation of the rotational speed and the discharge pressure of the hydraulic pump itself so that the input torques are decreased as the deviation of the rotational speed is increased and then on the basis of the object values, the input powers to the respective hydraulic pumps are controlled.

This known control system is designed to control the power input torque of each pump in accordance with the discharge pressure of the pump itself. In the known system having two variable displacement hydraulic pumps, for example, in order that one of the pumps can make full use of the power of the engine while the load on the other pump is substantially zero, it is necessary to set the input torque of each pump to be substantially the same as the maximum output torque of the engine.

In this conventional control system, when large loads are simultaneously applied to the two pumps by operation of their control levers, a torque which is twice the engine output torque is applied to the engine, so that the engine speed is decreased and the input torques of the pumps are limited on the basis of the deviation of the rotational speed to balance the output torque of the engine.

However, because of the large inertia of a fly-wheel which is provided in the engine for the purpose of suppressing the fluctuation in the engine speed due to intermittent explosion occurring in the cylinders of the engine, there is a time lag which inevitably occurs from the moment at which the large torque exceeding the instant engine output torque is applied to the engine till the moment at which the rotational speed thereof is decreased. The time lag is caused also when the rotational speed is increased due to a reduction in the load applied to the variable displacement hydraulic pumps.

Due to this time lag between the changes in the torque (load) and the rotational speed, the conventional system has suffered from hunting.

Further, in the above system, when the control lever for one of the pumps is operated so as to apply a large load thereto while the other pump is operating under a certain discharge rate, a total load exceeding the instant output torque of the engine might be applied to the engine, so that the engine speed would be decreased. In consequence, the input torque of to the hydraulic pumps are limited in accordance with the increased deviation of the rotational speed to balance with the engine output torque. In consequence, the discharge rate of the variable displacement hydraulic pump which has been operated under the certain discharge rate is decreased. Thus, the discharge rate of one the pumps is undesirably changed as a result of a change in the discharge rate of the other pump. That is to say, the discharge rates of both pumps cannot be controlled independently.

It would be possible to prevent the hunting and to control the discharge rates independently thereby stabilizing the control, if the maximum input torque of each variable displacement hydraulic pump is designed to be about one-half of the engine output torque. In such a case, however, each pump can make use only half the output of the engine when the load on the other pump is substantially zero.

These problems are experienced also when three or more pumps are employed.

SUMMARY OF THE INVENTION

Accordingly, an object of the present invention is to provide a control system for controlling input power to pumps which can avoid hunting and which enables the discharge rates of the variable displacement hydraulic pumps to be controlled independently, while making it possible to make the full use of the output power of the prime mover.

To this end, according to the invention, there is provided a control system for controlling input power to hydraulic pumps of a hydraulic driving system including a prime mover and a plurality of variable displacement hydraulic pumps driven by the prime mover, the control system comprising: first computing means for computing, for each of the hydraulic pumps, an input torque control value concerning a distribution of input torques of the hydraulic pumps from a representative pressure obtained on the basis of a discharge pressure of at least one other hydraulic pumps; second computing means for determining an input torque for each of the hydraulic pumps on the basis of a corresponding one of the input torque control values determined by the first computing means; and third computing means for determining an object discharge rate of each of the hydraulic pumps from the input torque obtained by the second computing means and an own discharge pressure of each of the hydraulic pumps.

DESCRIPTION OF THE PREFERRED EMBODIMENTS

Figure 1:
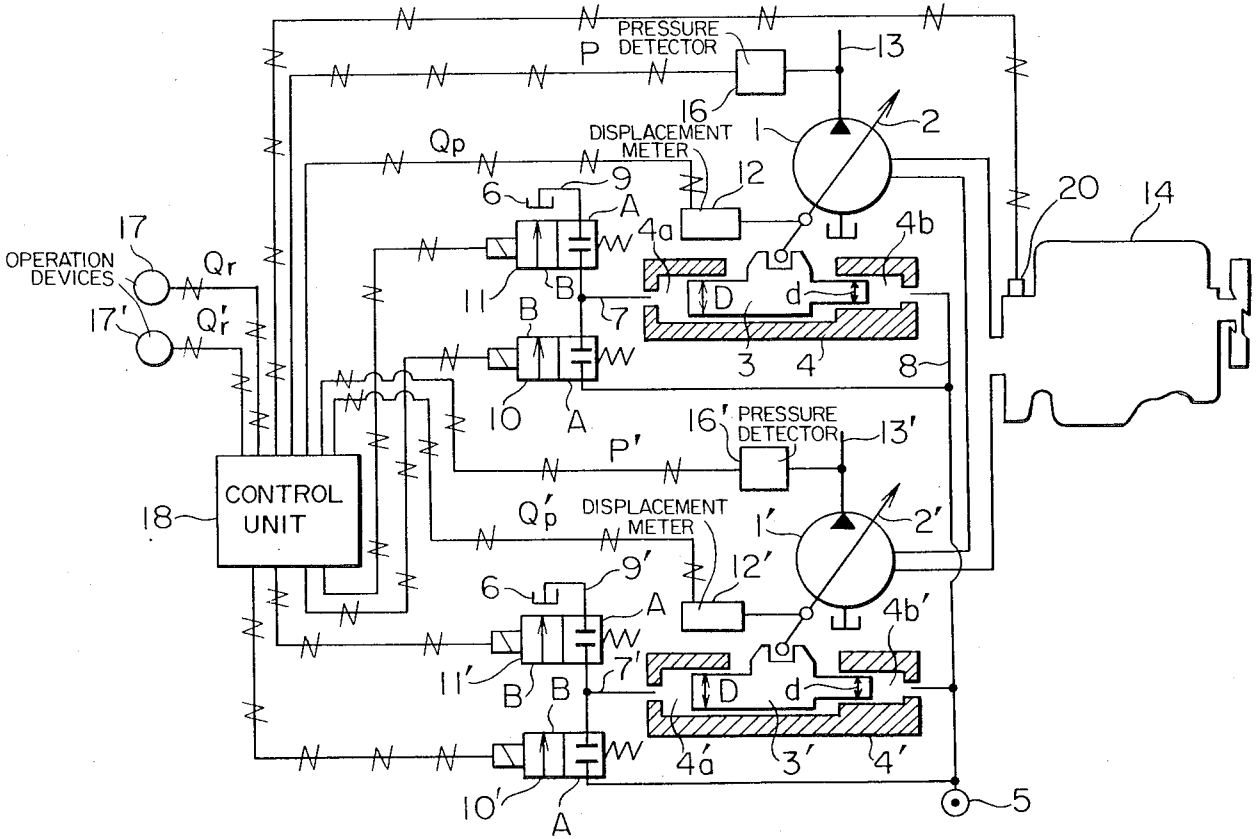
FIG. 1 is a circuit diagram of an embodiment of a control system in accordance with the present invention.

Referring to FIG. 1, a hydraulic driving system includes a prime mover 14 (referred to exemplarily as "engine" hereinafter) and first and second variable displacement hydraulic pumps 1 and 1′ driven by the engine 14. The hydraulic pumps have respective displacement volume control mechanisms 2, 2′ which are driven by servo pistons 3, 3′ received in servo cylinders 4, 4′. The servo cylinders 4, 4′ have internal cavities which are divided by the servo pistons 3, 3′ into left chambers 4*a*, 4*a*′ and right chambers 4*b*, 4*b* ′. The left chambers 4*a*, 4*a*′ have a cross-sectional area D which is greater than that d of the right chambers 4*b*, 4*b*′. Reference numerals 5 and 6 denote, respectively, a hydraulic pressure source for supplying a hydraulic fluid to the servo cylinders 4, 4′ and a reservoir which stores a hydraulic fluid used in the hydraulic circuit.

The hydraulic pressure source 5 is connected to the left chambers 4*a*, 4*a*′ of the servo cylinders 4, 4′ through conduits 7, 7′ and also to the right chambers 4*b*, 4*b*′ of the same through conduits 8, 8′.

The conduits 7, 7′ are connected to the oil reservoir 6 through return conduits 9, 9′. Solenoid valves 10, 10′ are disposed between the hydraulic pressure source 5 and the conduits 7, 7′, while solenoid valves 11, 11′ are disposed between the conduits 7, 7′ and the return conduits 9, 9′. These solenoid valves 10, 10′, 11 and 11′ are of normally-closed type which are reset to closing states when de-energized. Reference numerals 12, 12′ denote displacement meters for detecting the amounts of displacement of the displacement volume control mechanisms 2, 2′ and outputting discharge rate signals Qp, Qp′ corresponding to the detected amounts of the displacement. Reference numerals 13, 13′ designate discharge conduits leading from the variable displacement hydraulic pumps 1, 1′.

Pressure detectors 16, 16′ are disposed in the discharge conduits 13, 13′ for detecting the pressures of the hydraulic fluid discharged from respective pumps 1, 1′ and outputting electric discharge pressure signals P, P′ corresponding to the detected discharge pressures. Reference numerals 17, 17′ designate operation devices for varying the displacement volumes of the variable displacement hydraulic pumps 1, 1′. These operation devices output object discharge rate signals Qr, Qr′.

A reference numeral 20 designates an engine speed detector for detecting the speed of rotation of the engine 14.

Figure 2:
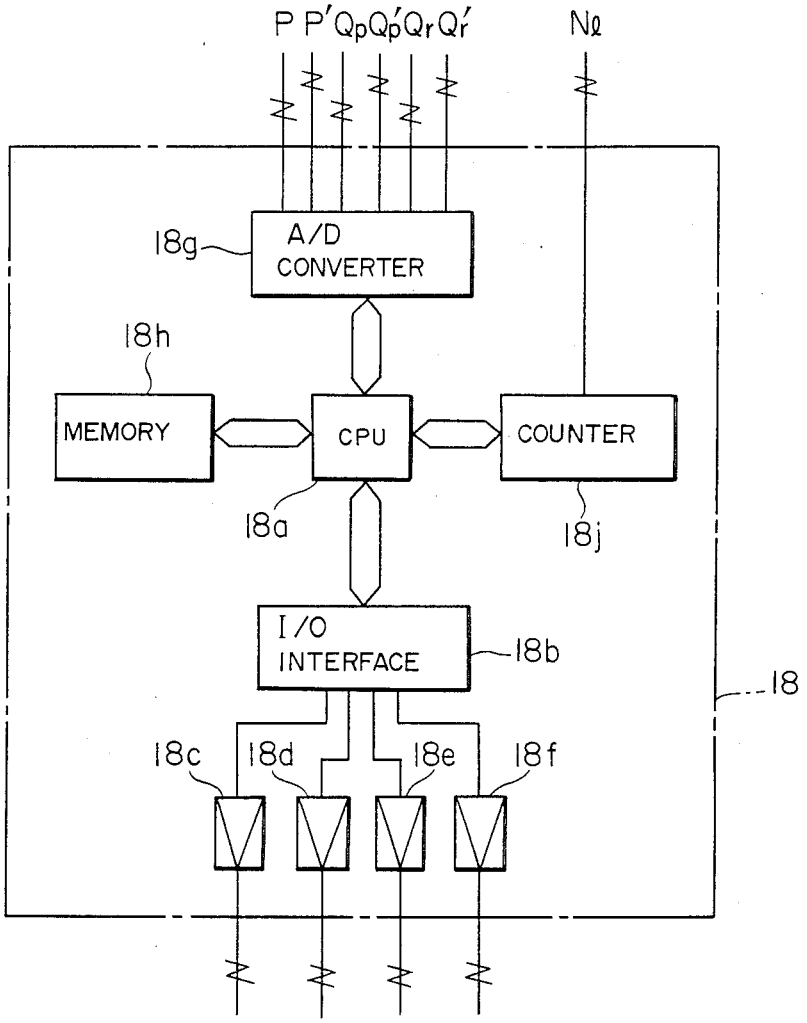
FIG. 2 is an illustration of a control unit incorporated in the control system shown in FIG. 1.

As will be seen from FIG. 2, a control unit 18, comprising a micro-computer, which constitutes a critical portion of the control system of the present invention, includes a central processing unit 18*a*, I/O interface 18*b* for output, amplifiers 18*c*, 18*d*, 18*e* and 18*f* respectively connected to the solenoid valves 10, 11, 10′ and 11′, a memory 18*h* for storing a program of the control process, an A/D converter 18*g* for converting analog signals including the discharge rate signals Qp, Qp′ derived from the displacement meters 12, 12′, discharge pressure signals P, P′ derived from the pressure detectors 16, 16′, and the object discharge rate signals Qr, Qr′ derived from the operation devices 17, 17′ into respective digital signals, and a counter 18*j* for detecting the pulses corresponding to the rotational speed Ne output by the speed detector 20 and for measuring the interval of the pulses.

The control unit 18 is designed to compute, based on the latter-described program of the control procedures stored in the memory 18*h*, object discharge rates Qps, Qps′ of the variable displacement pumps 1, 1′ and to finally output command signals Qo, Qo′, upon receipt of various signals including the discharge rate signals Qp, Qp′ from the displacement meters 12, 12′, discharge pressure signals P, P′ from the pressure detectors 16, 16′, object discharge rate signals Qr, Qr′ from the operation devices 17, 17′, and rotational speed Ne which is obtained through measurement of the pulse interval performed by the counter 18*j* which counts the pulses derived from the speed detector 20.

More specifically, the processing unit 18*a* of the control unit 18 comprises first, second and third computing means. The first computing means computes, from a first representative pressure P′ obtained on the basis of the discharge pressure P' of the variable displacement hydraulic pump 1', a first input torque control value δ concerning the distribution of an input torque of the variable displacement hydraulic pump 1, and also computes, from a second representative pressure P obtained on the basis of the discharge pressure P of the variable displacement hydraulic pump 1, a second input torque control value δ' concerning the distribution of an input torque of the variable displacement hydraulic pump 1' The second computing means computes a first input torque T for the hydraulic pump 1 on the basis of the first input torque control value δ obtained by the first computing means and also computes a second input torque T' for the hydraulic pump 1' on the basis of the second input torque control value δ', obtained by the first computing means. The third computing means computes, from the first input torque T obtained by the second computing means and the discharge pressure P of the hydraulic pump 1, an object discharge rate Qps of the hydraulic pump 1, and also computes, from the second input torque T' obtained by the second computing means and the discharge pressure P' of the hydraulic pump 1', an object discharge rate Qps' of the hydraulic pump 1'.

Particularly, in the described embodiment under description, the central processing unit 18*a* further includes fourth computing means for computing an input torque control value $\delta_N$ concerning the total of the input torques from the deviation between the actual rotational speed Ne and the object rotational speed $N_o$ of the engine 14, and the first computing means is adapted to compute the first and second input torque control values δ, δ' respectively concerning the distribution of the input torques of the pumps 1, 1' on the basis of the input torque control value $\delta_N$ obtained by the fourth computing means and the first and the second representative pressures P, P'.

The command signals Qo, Qo' output from the control unit 18 are fed to the solenoid valves 10, 10', 11, 11'. The positions of the servo pistons 3, 3' are controlled by means of on-off servo control using an electric hydraulic servo system so that the discharge rate signals Qp, Qp' which are the outputs of the displacement meters 12, 12' become equal to the command signals Qo, Qo'.

To explain in more detail about the on-off servo control, when the solenoid valves 10, 10' are energized to be switched to the positions B, the left chambers 4*a*, 4*a'* of the servo cylinders 4, 4' are brought into communication with the hydraulic pressure source 5, so that the servo pistons 3, 3' are moved to the right as viewed in FIG. 1 due to difference in the area between the left chambers 4*a*, 4*a'* and the right chambers 4*b*, 4*b'*. When the solenoid valves 10, 10' and the solenoid valves 11, 11' are de-energized to be returned to positions A, the conduits to the left chambers 4*a*, 4*a'* are shut-off, so that the servo pistons 3, 3' are kept at the instant positions. Then, when the solenoid valves 11, 11' are energized to be switched to positions B, the left chambers 4*a*, 4*a'* are brought into communication with the reservoir 6, so that the pressures in these chambers are lowered. In consequence, the servo pistons 3, 3' are moved to the left as viewed in FIG. 1, due to the pressure residing in the right chambers 4*b*, 4*b'*.

The control process performed by the control unit 18 of the described embodiment will be explained hereinafter, with reference to FIG. 3.

In Step Sla, the central processing unit 18*a* reads various state values including the discharge pressure signals P, P' from the pressure detectors 16 16', discharge rate signals Qp, Qp' from the displacement meters 12, 12', object discharge rate signals Qr, Qr' from the operation devices 17, 17', and the rotational speed Ne of the engine 14 obtained by the counter 18*j* from the signal delivered by the speed detector 20.

In Step S2a, the fourth computing means computes the deviation of the rotational speed ΔN in accordance with the following formula (1), on the basis of the read rotational speed Ne and a pre-set object rotational speed No (which, for example, is the rated rotational speed of the engine 14.)

$$\Delta N = Ne - No \ldots \quad (1)$$

Figure 4:
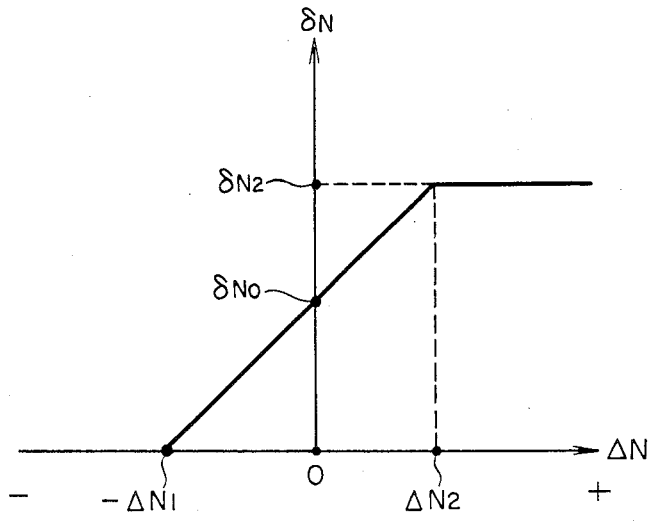
FIG. 4 is a diagram illustrating a relationship between a deviation of the rotational speed and the input torque of control value for each of variable displacement hydraulic pumps, the relationship being set in the control unit shown in FIG. 2.

Using the deviation of the rotational speed ΔN thus obtained, a computation is conducted to determine the input torque control value $\Delta_N$ concerning the total of the input torques of the pumps in accordance with a formula $\delta_N = f(\Delta N)$. FIG. 4 shows an example of the functional relationship $\delta_N = f(\Delta N)$. This functional relationship can be expressed by the following formulae.

On condition of $\Delta N < -\Delta_{N1}$, $$\delta_N = 0 \quad (2)$$

On condition of $-\Delta N_1 \leqq \Delta N \leqq \Delta N_2$, $$\delta_N = \alpha \Delta N + \delta_{N0} \quad (3)$$

where $\alpha = \delta_{N2}/(\Delta\text{-}N_2 + \Delta N_1)$ and $\delta_{N0}$, $\delta_{N2}$, $\Delta_{N2}$, and $\Delta N_1$ are constants.

On condition of $\Delta N > \Delta N_2$, $$\delta_N = \delta_{N2} \quad (4)$$

Then, the process proceeds to Step S3*a* in which the discharge pressure signal P of the first hydraulic pump 1 is determined as a second representative pressure and the discharge pressure signal P' of the second hydraulic pump 1' is determined as a first representative pressure and a calculation for determining the input torque control value $\delta = g(P', \delta_N)$ concerning the distribution of the input torque of the first hydraulic pump 1 and the input torque control value $\delta' = g(P, \delta_N)$ concerning the distribution of the input torque of the second hydraulic pump 1' from the input torque control value $\delta_N$ obtained by the fourth computing means and the first and second representative pressure P, P' is effected by the first computing means.

Figure 5:
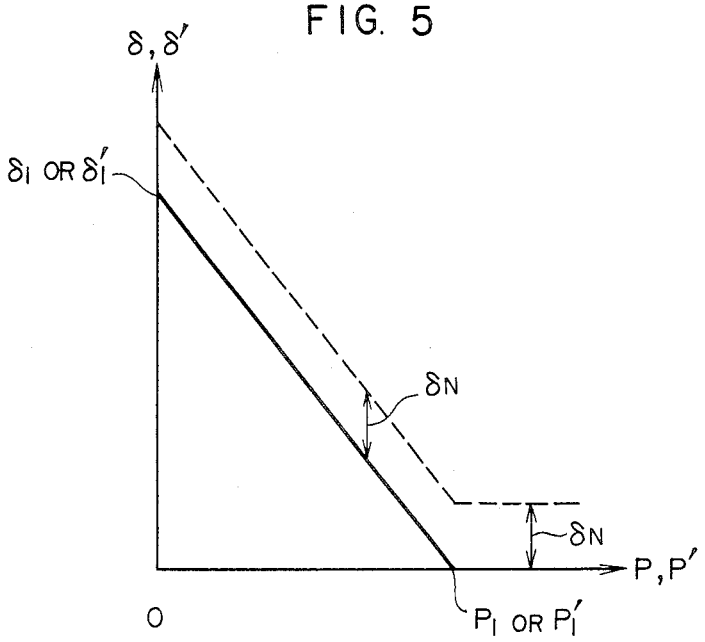
FIG. 5 is a diagram illustrating a relationship between a discharge pressure of each of the variable displacement hydraulic pumps and of the input torque control value for each of the variable displacement hydraulic pumps, the relationship being set in the control unit shown in FIG. 2.

FIG. 5 shows these functions by way of example. These functions can be expressed by the following formulae.

On condition of $P' \leqq P_1$, $$\delta = \beta \cdot P' + \delta_1 + \delta_N \quad (5)$$

where, $\beta = \delta_1/P_1$, and $\delta_1$ and $P_1$ are constants.

On condition of $P' > P_1$, $$\delta = \delta_N \quad (6)$$

Similarly, on condition of $P \leqq P_1'$, $$\delta' = -\beta' \cdot P + \delta_1' + \delta_N \quad (7)$$

where, $\beta' = \delta_1'/P_1'$, and $\delta_1'$ and $P_1'$ are constants.

On condition of $P > P_1'$, $$\delta' = \delta_N \quad (8)$$

Subsequently, the process proceeds to Step S4*a* in which the following operation is performed by the second computing means. Firstly, first input torque T of the first hydraulic pump 1 is determined as follows, from minimum input torque Tmin which is preset for the first hydraulic pump 1 and the first input torque control value δ determined by the first computing means.

$$T = Tmin + \delta \quad (9)$$

Also, the third computing means determines the object discharge rate Qps for the first hydraulic pump 1 in accordance with the following formula (10) from the discharge pressure signal P representing the discharge pressure of the first hydraulic pump 1 and the torque T determined in accordance with the formula (9).

$$Qps = T/P \quad (10)$$

The same computations are conducted also for the second hydraulic pump 1' as follows, so that the object discharge rate Qps' for the second hydraulic pump 1' is obtained.

$$T' = Tmin + \delta' \quad (11)$$

$$Qps' = T'/P' \quad (12)$$

The computations of the formulae (10) and (12) may be conducted directly by dividing operation. However, considering that the dividing operation in general requires a long processing time, it is helpful to adopt the following approximating computations.

Figure 6:
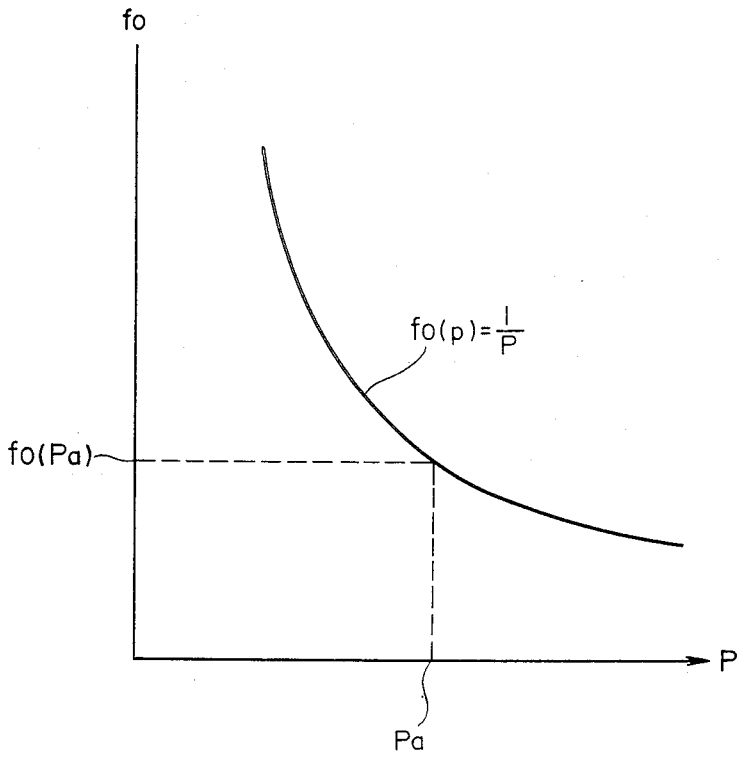
FIG. 6 is a diagram illustrating the approximating computing method performed in a third computing means incorporated in the control unit shown in FIG. 2.

Referring to FIG. 6, an example of such approximating computations includes the steps of presetting a hyperbolic curve $f_o(P) = 1/p$ as a reference in the memory 18*h*, reading the value $f_o(Pa)$ of the hyperbolic curve from the memory 18*h* in accordance with the discharge pressure signal P=Pa, and conducting the following multiplying computation.

$$QPs = f_o(Pa) \times (Tmin + \delta) \quad (13)$$

The use of multiplying operation, instead of the dividing operation, remarkably shortens the processing time.

In another approximating computation, a hyperbolic curve of the following formula is stored in the memory 18*h*, and the value approximating Qps is determined by changing the coordinate axes of Qps and P in response to δ.

$$Qps = Tmin/P \quad (14)$$

The computations are thus performed by the first, second, third and the fourth computing means. The process then proceeds to Step S5*a*.

In Step S5*a*, the smaller one of the object discharge rate Qps of the first hydraulic pump 1 obtained in Step S4*a* and the object discharge rate signal Qr provided by the operation device 17 is selected and used as the command signal Qo. Similarly, the smaller one of the object discharge rate Qps' of the second hydraulic pump 1' obtained in Step S4*a* and the object discharge rate signal Qr' provided by the operation device 17' is selected and used as the command signal Qo'.

In Step S6*a*, the discharge rates of the first and second hydraulic pumps 1, 1' are controlled in accordance with the respective command values Qo and Qo'.

Since, the speed of the engine is regarded as being constant, the controlling of the discharge rate of each pump means controlling of the displacement volume of the pump, i.e., the tilting angle of a swash plate (angle of the member 2 or 2' in FIG. 1) in case of a swash plate pump.

Thus, in the described embodiment, the discharge rate of each of two hydraulic pumps is controlled taking into account both the own discharge pressure and the discharge pressure of the other pump, so that the total power of the hydraulic pumps is controlled stably.

Namely, in the control system of the described embodiment, the first computing means computes, from the signal P' indicative of the discharge pressure of the second hydraulic pump 1', a first input torque control value δ concerning the distribution of the input torque shared by the first hydraulic pump 1, and also computes, from the signal P indicative of the discharge pressure of the hydraulic pump 1, a second input torque control value δ' concerning the distribution of the input torque shared by the hydraulic pump 1'. Thus, the input torque of each pump is controlled while taking into consideration the input torque of the other pump, so that it is possible to control the levels of input torque of both pumps in such a manner that the total of the torque values falls within the range of the output torque of the engine.

Therefore, even if the operation devices are operated so as to apply heavy loads input to both the hydraulic pumps, the sum of the input torques of both the hydraulic pumps does not exceed the output torque of the engine. This in turn eliminates any reduction of the engine speed, so that the undesirable hunting of the control is prevented. Further, when one pump starts a discharge of the hydraulic fluid while the other pump is operating with a certain discharge rate, the discharge rate of the first-mentioned pump is controlled within the range of the input torque distributed to this pump, so that the discharge rates of both pumps can be controlled independently without being influenced by each other. In addition, when the load on one of the hydraulic pumps is zero or very small, the other hydraulic pump can use all portion of the engine output torque available, so that the output power of the engine can be fully utilized.

When the fourth computing means is used, on the basis of an input torque control value $\delta_N$ concerning the total summation of the input torque of the pumps obtained by the forth computing means, the first computing means is adapted to compute the first and second input torque control values δ, δ' concerning the distribution of the input torques of the first and the second hydraulic pumps. It is, possible to control the sum of the input torques so as to match the output torque of the engine. When the fourth computing means is used, therefore, the input torques are exactly controlled even when the measuring precisions of the pressure detectors and the displacement meters are not so good. Further, if the detectors have been deteriorated to lower their output levels, the control system can control the input torque values on the basis of the lowered output levels. In addition, the input torque values can be satisfactorily controlled even when the output characteristic of the engine is lowered by thin air due to, for example, an increase in the altitude.

Although the first and the fourth computing means employ linear functions as shown in FIGS. 4 and 5, such linear functions are only illustrative, and the computing means can have various desired functions without requiring changes or modifications of parts other than those of the control device 18.

In the described embodiment, the fourth computing means for computing the input torque control value $\delta_N$ concerning the total of the input torques of the hydraulic pumps is provided in order to comply with the actual output power of the engine but it is not necessarily needed as well as the embodiment described hereinafter and shown in FIG. 9. Even if the fourth computing means is not provided, the advantageous effects such as the prevention of the hunting and independent control of the discharge rates of the pumps as well as the full use of the output power of the engine can be obtained.

In the embodiment described hereinbefore, the discharge pressure P' of the hydraulic pump P' and the discharge pressure P of the hydraulic pump 1 are determined as the first and second representative pressures, respectively in the first computing means. This method, however, is not exclusive and the representative pressures may be determined in accordance with different methods.

Figure 7:
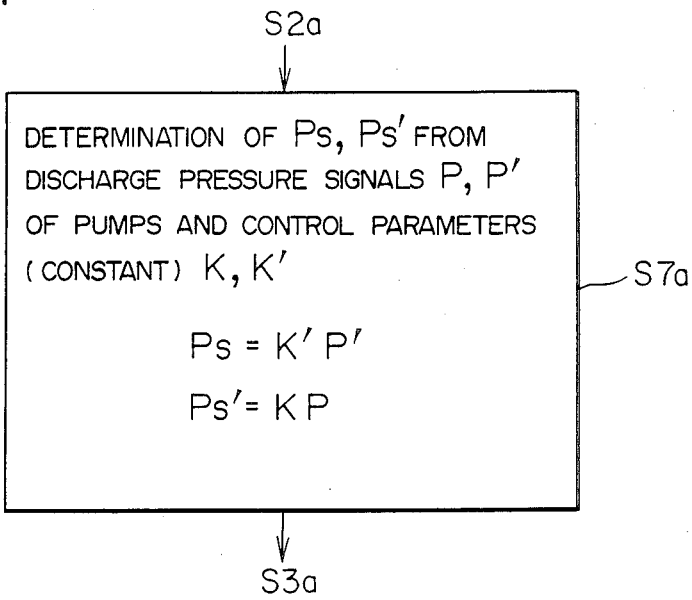
FIG. 7 shows a part of a flow chart illustrating another example of a method of determining the representative pressure in the process shown in FIG. 3.
Figure 8:
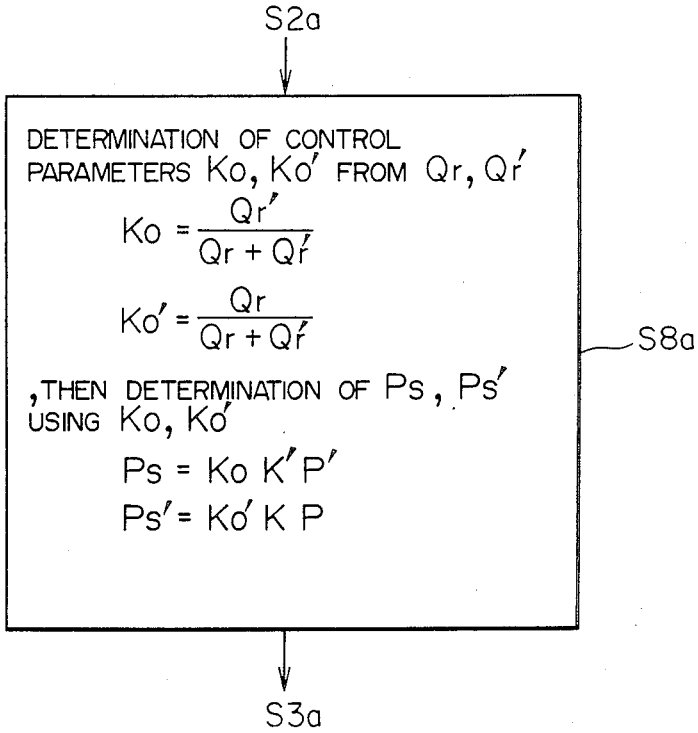
FIG. 8 shows a part of a flow chart illustrating still another example of a method of determining the representative pressure in the process shown in FIG. 3.

FIGS. 7 and 8 are illustrations of examples of such methods for determination of the representative pressures. In each case, Step S7*a* or S8*a* is followed after the Step S2*a* of the process shown in FIG. 3 and, after Step S7*a* or S8*a* is completed, the process proceeds to Step S3*a* shown in FIG. 3.

In the method shown in FIG. 7, the first computing means stores beforehand therein a first control parameter K determined in relation to the discharge capacity of the hydraulic pump 1 and a second control parameter K' determined in relation to the discharge capacity of the hydraulic pump 1'. The first computing means then performs computation for determining the first representative pressure as the product of the second control parameter K' and the discharge pressure P' of the hydraulic pump 1', as well as computation for determining the second representative pressure as the product of the first control parameter K and the discharge pressure P of the hydraulic pump 1. Namely, the first computing means conducts the following computation.

$$Ps = K' \cdot P'$$

$$Ps' = K \cdot P$$

In this method, the use of the control parameters K, K' by which the discharge pressures are multiplied has the following significance. In general, the discharge capacities of both pumps are not always equal. For instance, the discharge capacity of the hydraulic pump 1 is greater than that of the hydraulic pump 1'.

In such a case, even if both hydraulic pumps exhibit the same discharge pressure, the variable displacement hydraulic pump 1' imposes a smaller load on the engine than the variable displacement hydraulic pump 1. This means that the distribution of the input torque to the hydraulic pump 1 may be increased.

In view of this fact, the method shown in FIG. 7 proposes to multiply the discharge pressure of each pump by the control parameter, in order to take into account the level of the actual load imposed on the other of the hydraulic pumps. More specifically, when the ratio of the discharge capacity between the hydraulic pump 1 and the hydraulic pump 1' is 7:3, it is possible to determine the representative pressures corresponding to the actual load level by determining the control parameters K and K' as K=0.3 and K'=0.7.

This enables the input torque distribution to meet the actual load levels, thus further ensuring that the power of the engine is fully utilized.

Referring now to the method shown in FIG. 8, the first and second control parameters K, K' mentioned above are preset in the first computing means as well. In addition, a third control parameter Ko is determined by dividing a first command value Qr given by the operation device for commanding the discharge rate of the hydraulic pump 1 by the sum of the first command value Qr and a second command value Qr' given by the operation device for commanding the discharge rate of the hydraulic pump 1', and a fourth control parameter Ko' is determined by dividing the second command value Qr' by the sum of the first and second command values Qr and Qr'. The first representative pressure Ps is determined as the product of the third parameter Ko, the second parameter K' and the discharge pressure P' of the hydraulic pump 1'. Similarly, the second representative pressure is determined as the product of the fourth parameter Ko', the first parameter K and the discharge pressure P of the hydraulic pump 1. Thus, the following computations are conducted in this case.

$$Ko = Qr'/(Qr + Qr')$$

$$Ko' = Qr'/(Qr + Qr')$$

$$Ps = Ko \cdot K' \cdot P'$$

$$Ps' = Ko' \cdot K \cdot P$$

The significance of the multiplication of the discharge pressures by the first and second control parameters K, K' have been explained already. In this method, third and fourth control parameters Ko, Ko' are used in addition to the first and second control parameters. The meaning or significance of the use of these parameters Ko, Ko' is as follows.

The discharge rates of the hydraulic pumps 1, 1' are controlled by the command values Qr, Qr' given by the operation devices 17, 17'. Usually, these command values are different from each other. It is assumed here that the command value Qr is greater than the command value Qr'. This means that the operator intends to perform a work which comprises T>T'. In such a case, the input torque control values $\delta$ and $\delta'$ concerning the distribution of torque input to the pumps 1, 1' are preferably determined so as to be $\delta > \delta'$. To this end, control parameters Ko and Ko' are computed on the basis of the command values Qr and Qr' and the representative pressures are computed taking into account the control parameters Ko and Ko' as above-mentioned. With this arrangement, a share of the input torque can be obtained and it is possible to obtain an input torque distribution intended by the operator and to make effective use of the output power of the engine.

Figure 3:
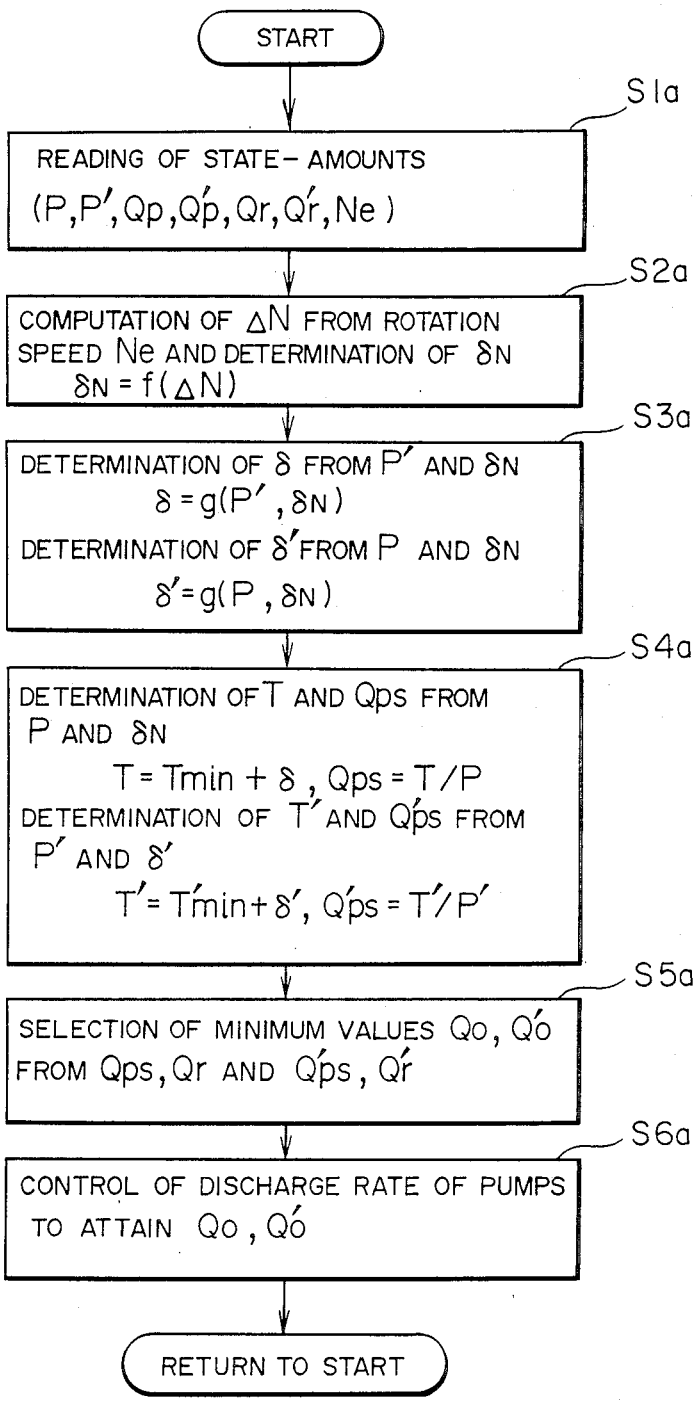
FIG. 3 is a flow chart showing the control process performed by the control unit shown in FIG. 2.

When the Step S7*a* or S8*a* is taken, the values P and P' appearing in Step S3*a* onwards in the process shown in FIG. 3 are to be substituted by Ps and Ps', respectively.

Another embodiment of the present invention will be described hereinafter with reference to FIG. 9. In this drawing, the same reference numerals are used to denote the same parts as those appearing in FIG. 1, and detailed description of such parts is omitted.

Figure 9:
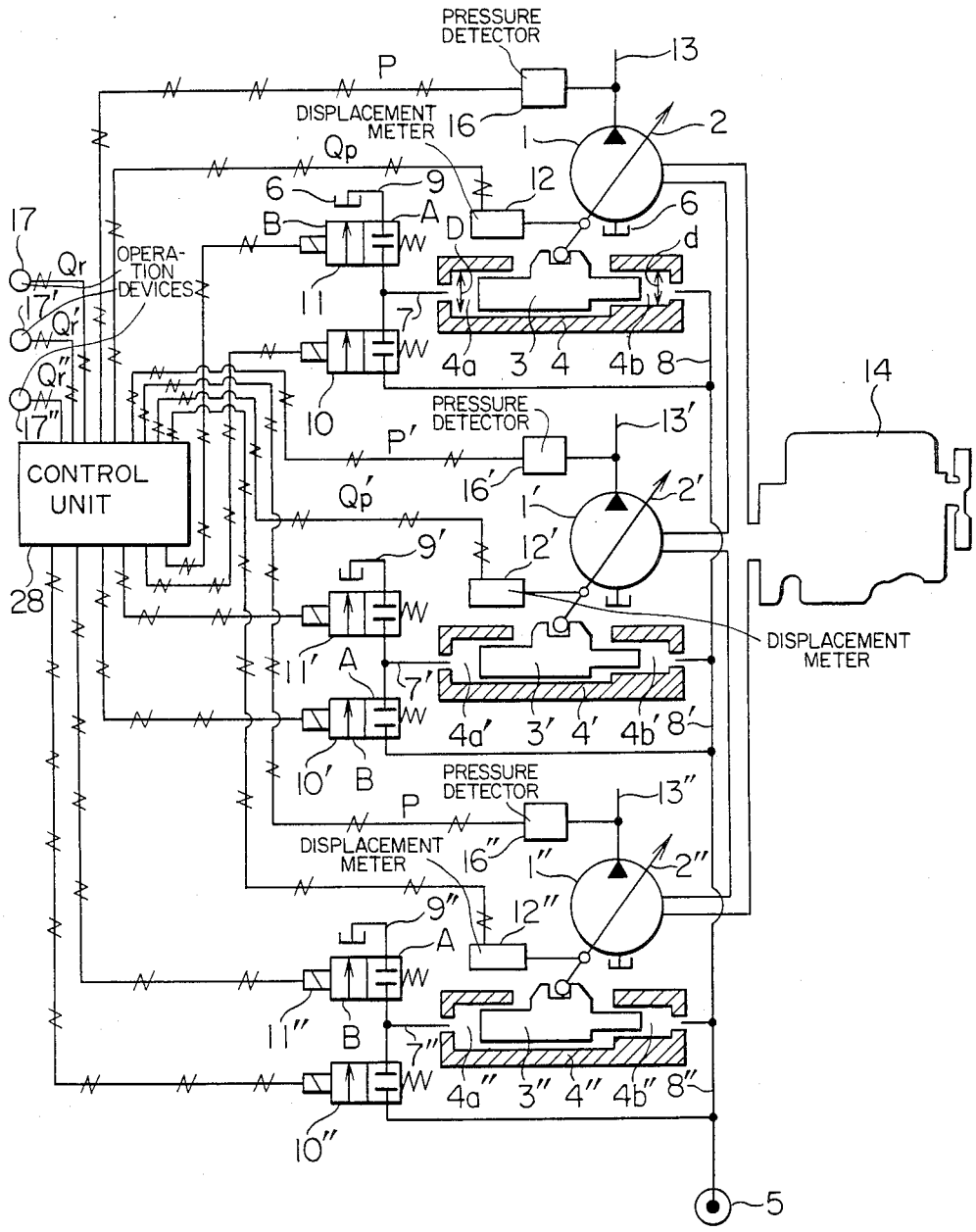
FIG. 9 is a circuit diagram of another embodiment of a control system in accordance with the present invention.

Referring to FIG. 9, reference numeral 1″ denotes a third variable displacement hydraulic pump which also is driven by the engine 14 and which has a displacement volume control mechanism 2″. The displacement volume control mechanism 2″ is adapted to be driven by a servo piston 3″ which is received in a servo cylinder 4″. The servo cylinder 4″ has internal cavity which is divided by the servo piston 3″ into a left chamber 4a″ and a right chamber 4b″. The left chamber 4a″ has a cross-sectional area D which is greater than that d of the right chamber 4b″.

The hydraulic pressure source 5 is connected to the left chamber 4a″ of the servo cylinder 4″ through a conduit 7″ and also to the right chamber 4b″ of the same through a conduit 8″.

The conduit 7″ is connected to the reservoir 6 through a return conduit 9″. A solenoid valve 10″ is disposed between the hydraulic pressure source 5 and the conduit 7″, while a solenoid valve 11″ is disposed between the conduit 7″ and the return conduit 9″. These solenoid valves 10″, 11″ are of normally-closed type which return to closing states when de-energized. Reference numeral 12″ denotes a displacement meter for detecting a displacement of the displacement volume control mechanism 2″ and for outputting a discharge rate signal Qp″ in proportion to the detected amounts of displacement. Reference numeral 13″ designates a discharge conduit leading from the hydraulic pumps 1″.

A pressure detector 16″ is disposed in the discharge conduit 13″ for detecting the pressure of a hydraulic fluid discharged from the pump 1″ and outputting an electric discharge pressure signal P″ corresponding to the detected discharge pressure. Reference numeral 17″ designates an operation device for varying the displacement rate of the hydraulic pump 1″ and for outputting an object discharge rate signal Qr″.

Figure 10:
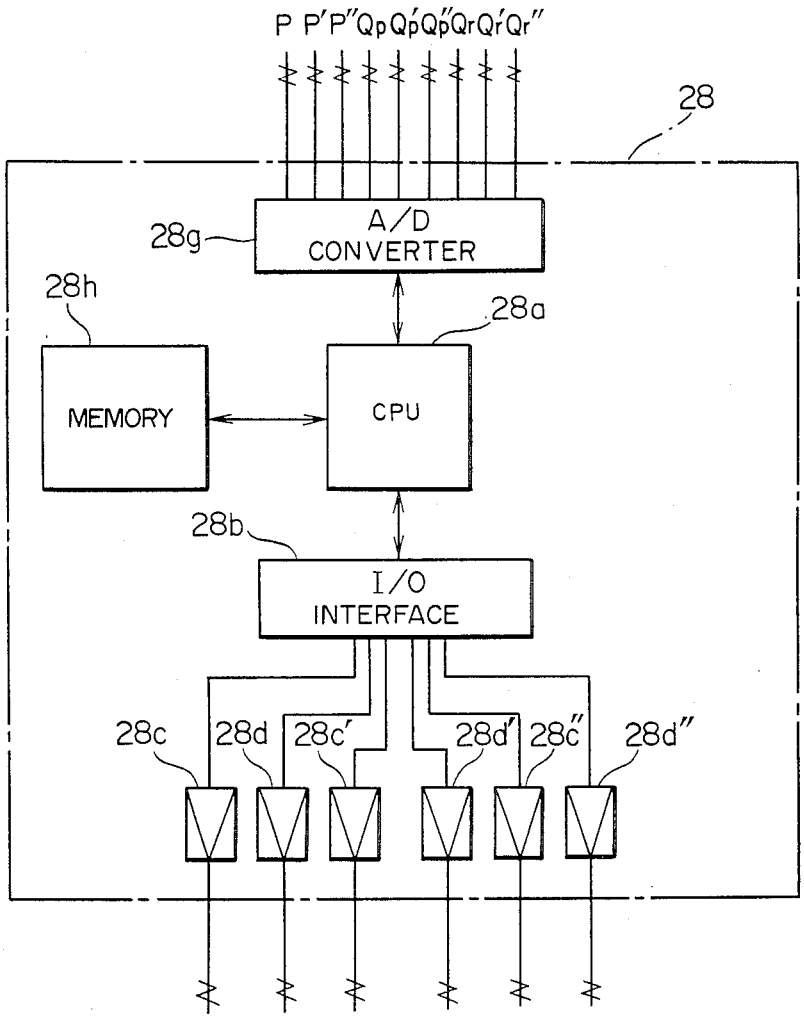
FIG. 10 is an illustration of a control unit incorporated in the control system shown in FIG. 9.

As will be seen from FIG. 10, a control unit 28, which constitutes a critical portion of the power control system of this embodiment, has a central processing unit 28a, I/O interface 28b for output, amplifiers 28c, 28d, 28c′, 28d′, 28c″, 28d″ respectively connected to the solenoid valves 10, 11, 10′, 11′, 10″, 11″, a memory 28h for storing the program of the control process, and an A/D converter 28g for converting analog signals including the discharge rate signals Qp, Qp′, Qp″ derived from the displacement meters 12, 12′, 12″, discharge pressure signals P, P′, P″ derived from the pressure detectors 16, 16′, 16″, and the object discharge rate signals Qr, Qr′, Qr″ derived from the operation devices 17, 17′, 17″ into respective digital signals.

The control device 28 is designed to compute, in accordance with a program stored in the memory 28h which will be explained later, the object discharge rates Qps, Qps′, Qps″ of the pumps 1, 1′, 1″ and to finally output the command signals Qo, Qo′, Qo″ upon receipt of various signals including the discharge rate signals Qp, Qp′, Qp″ from the displacement meters 12, 12′, 12″, discharge pressure signals P, P′, P″ derived from the pressure detectors 16, 16′, 16″, and object discharge rate signals Qr, Qr′, Qr″ from the operation devices 17, 17′, 17″.

More specifically, the processing unit 28a of the control unit 28 comprises the following computing means: namely, first computing means which includes fifth and sixth computing means, the fifth means being adapted for computing a first representative pressure Ps on the basis of the discharge pressure P′ of the hydraulic pump 1′ and the discharge pressure P″ of the hydraulic pump 1″, determining a second representative pressure Ps′ on the basis of the discharge pressure P of the hydraulic pump 1 and the discharge pressure P″ of the hydraulic pump 1″, and determining a third representative pressure Ps″ on the basis of the discharge pressure P of the hydraulic pump 1 and the discharge pressure P′ of the hydraulic pump 1′, the sixth computing means being adapted for computing, from the first representative pressure Ps obtained by the fifth computing means, a first input torque control value δ concerning the distribution of the input torque shared by the hydraulic pump 1, and, from the second representative pressure Ps′, a second input torque control value δ′ concerning the distribution of the input torque shared by the hydraulic pump 1′, and, from the third representative pressure Ps″, a third input torque control value δ″ concerning the distribution of the input torque shared by the variable displacement hydraulic pump 1″; second computing means for computing a first input torque T for the hydraulic pump 1 on the basis of the first input torque control value δ obtained by the first computing means, a second input torque T′ for the hydraulic pump 1′ on the basis of the second input torque control value δ′ obtained by the first computing means, and a third input torque T″ for the hydraulic pump 1″ on the basis of the second input torque control value δ″ obtained by the first computing means; and third computing means for computing, from the first input torque T obtained by the second computing means and the discharge pressure P of the hydraulic pump 1, an object discharge rate Qps of the hydraulic pump 1, computing, from the second input torque T′ obtained by the second computing means and the discharge pressure P′ of the hydraulic pump 1′, an object discharge rate Qps′of the hydraulic pump 1′, and from the third input torque T″ obtained by the second computing means and the discharge pressure P″ of the hydraulic pump 1″, an object discharge rate Qps″ of the hydraulic pump 1″.

The command signals Qo, Qo′, Qo″ output from the control unit 28 are fed to the solenoid valves 10, 10′, 10″, 11, 11′, 11″. The positions of the servo pistons 3, 3′, 3″ are controlled by means of on-off servo control using an electric hydraulic servo system so that the discharge rate signals Qp, Qp′, Qp″ which are the output of the displacement meters 12, 12′, 12″ become equal to the command signals Qo, Qo′, Qo″.

To explain in more detail about the on-off servo control, when the solenoid valves 10, 10′, 10″ are energized to be switched to the positions B, the left chambers 4a, 4a′, 4a″ of the servo cylinders 4, 4′, 4″ are brought into communication with the hydraulic pressure source 5, so that the servo pistons 3, 3′, 3″ are moved to the right as viewed in FIG. 9 due to difference in the area between the left chambers 4a, 4a′, 4a″ and the right chambers 4b, 4b′, 4b″. When the solenoid valves 10, 10′, 10″ and the solenoid valves 11, 11′, 11″ are de-energized to be returned to positions A, the conduits to the left chambers 4a, 4a′, 4a″ are shutoff, so that the sevo pistons 3, 3′, 3″ are kept at the instant positions. Then, when the solenoid valves 11, 11′, 11″ are energized to be switched to positions B, the left chambers 4a, 4a′, 4a″ are brought into communication with the reservoir 6, so that the pressures in these chambers are lowered. In consequence, the servo pistons 3, 3′, 3″ are moved to the left as viewed in FIG. 1, due to the pressure residing in the right chambers 4b, 4b', 4b''.

The control process performed by the control unit 28 of the described embodiment will be explained hereinafter, with reference to FIGS. 11(a) and 11(b).

Figure 11A:
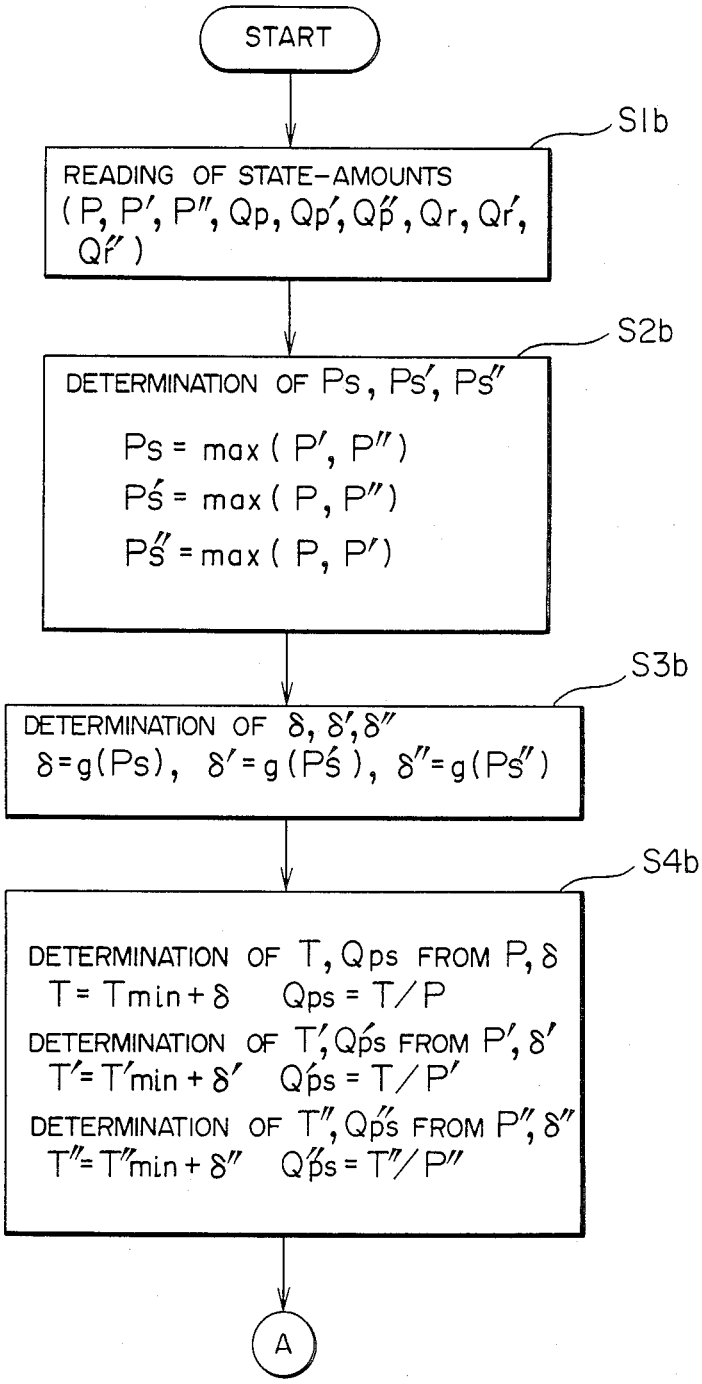
FIGS. 11(*a*) and 11(*b*) are flow charts showing the control process performed by the control unit shown in FIG. 10.
Figure 11B:
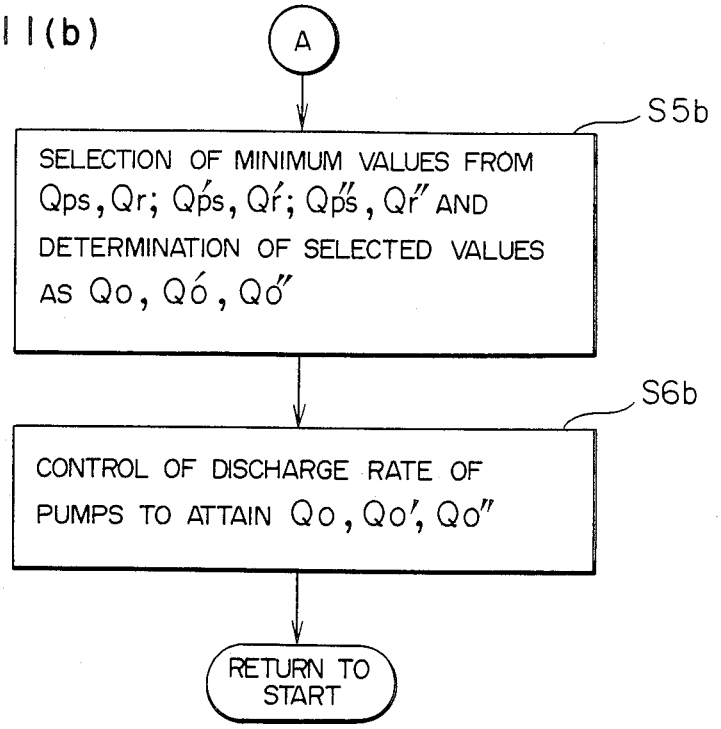

As shown in FIG. 11(a), in Step S1b, the central processing unit 28a reads various state values including the discharge pressure signals P, P', P'' from the pressure detectors 16, 16', 16'', discharge rate signals Qp, Qp', Qp'' from the displacement meters 12, 12', 12'', and object discharge rate signals Qr, Qr', Qr'' from the operation devices 17, 17', 17''.

In next Step S2b, the first computing means conducts a computation for determining the first, second and third representative pressures Ps, Ps', Ps''. The greater one of the discharge pressure signal P' of the second hydraulic pump 1' and the discharge pressure signal P'' of the third hydraulic pump 1'' is selected and determined as the first representative pressure Ps. The greater one of the discharge pressure signal P of the first hydraulic pump 1 and the discharge pressure signal P'' of the third hydraulic pump 1'' is selected and determined as the second representative pressure Ps'. Similarly, the greater one of the discharge pressure signal P of the first hydraulic pump 1 and the discharge pressure signal P' of the second hydraulic pump 1' is selected and determined as the third representative pressure Ps'.

Then process proceeds to Step S3b in which a computation is performed for determining the input torque control value $\delta = g\ (Ps)$ concerning the distribution of the input torque shared by the first hydraulic pump and the input torque control value $\delta' = g\ (Ps')$ concerning the distribution of the input torque shared by the second hydraulic pump 1', as well as the input torque control value $\delta'' = g\ (Ps'')$ concerning the distribution of the input torque shared by the third hydraulic pump 1''. These operations are conducted on the basis of the first, second and third representative pressures Ps, Ps' and Ps'', respectively.

Figure 12:
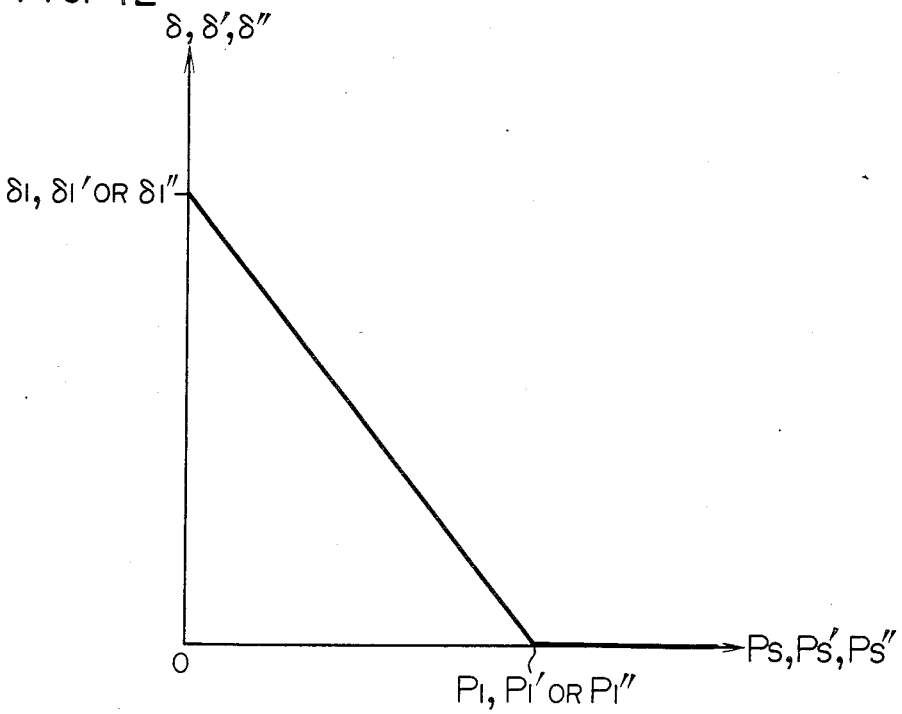
FIG. 12 is a diagram illustrating a relationship between representative pressure and input torque control value for each of variable displacement hydraulic pumps, the relationship being set in the control unit shown in FIG. 10.

FIG. 12 shows examples of these functions $6 = g\ (Ps)$, $\delta' = g\ (Ps')$ and $6'' = g\ (Ps'')$. These functions can be expressed by the following formulae.

On condition of $Ps \leqq P_1$, $$\delta = -\beta \cdot Ps + \delta_1 \quad (1)$$

where, $\beta = \delta_1/P_1$, and $\delta_1$ and $P_1$ are constants.

On condition of $Ps > P_1$, $$\delta = 0 \quad (2)$$

On condition of $Ps' \leqq P_1'$ $$\delta' = -\beta' \cdot Ps' + \delta_1' \quad (3)$$

where, $\beta' = \delta_1'/P_1'$, and $\delta_1'$ and $P_1'$ are constants.

On condition of $Ps' \leqq P_1'$, $$\delta' = 0 \quad (4)$$

On condition of $Ps'' \leqq P_1''$, $$\delta'' = -\beta'' \cdot Ps'' + \delta_1'' \quad (5)$$

where, $\beta'' = \delta_1''/P_1$41 , and $\delta_1''$ and $P_1''$ are constants.

On condition of $Ps'' > P_1''$, $$\delta'' = 0 \quad (6)$$

Subsequently, the process proceeds to Step S4b in which the following operation is performed by the second computing means. Firstly, first input torque T for the first hydraulic pump 1 is determined as follows, from minimum input torque Tmin which is preset for the first hydraulic pump 1 and the first input torque control value $\delta$ determined by the first computing means.

$$T = Tmin + \delta \quad (7)$$

Then, the third computing means determines the object discharge rate Qps for the first hydraulic pump 1 in accordance with the following formula (8) from the discharge pressure signal P of the first hydraulic pump and the torque T determined in accordance with the formula (7).

$$Qps = T/P \quad (8)$$

The same computations are conducted also for the second hydraulic pump 1' and the third hydraulic pump 1'' as follows, so that the object discharge rates Qps' and Qps'' for the second and third hydraulic pumps ' and 1'' are obtained.

$$T' = T'min + \delta' \quad (9)$$

$$Qps' = T'/P' \quad (10)$$

$$T'' = T''min + \delta'' \quad (11)$$

$$Qps'' = T''/P'' \quad (12)$$

The computations are thus performed by the first, second and third computing means. The process then proceeds to Step S5b.

In Step S5b, the smaller one of the object discharge rate Qps of the first hydraulic pump 1 obtained in Step S4b and the object discharge rate signal Qr provided by the operation device 17 is selected and used as the command signal Qo. Similarly, the smaller one of the object discharge rate Qps' of the second hydraulic pump 1' obtained in Step S4b and the object discharge rate signal Qr' provided by the operation device 17' is selected and used as the command signal Qo'. In addition, the smaller one of the object discharge rate Qps'' of the third hydraulic pump 1'' obtained in Step S4b and the object discharge rate signal Qr'' provided by the operation device 17'' is selected and used as the command signal Qo''.

In Step S6b, the discharge rates of the first, second and third hydraulic pumps 1, 1', 1'' are controlled in accordance with the respective command signals Qo, Qo' and Q''.

Thus, in the described embodiment, the discharge rate of each of three variable displacement hydraulic pumps is controlled by taking into account the own discharge pressure and the discharge pressures of the other pumps, so that the total input power of the hydraulic pumps is controlled stably similarly with the embodiment shown in FIG. 1.

Obviously, the same advantage is obtained even when four or more pumps are employed.

Figure 13:
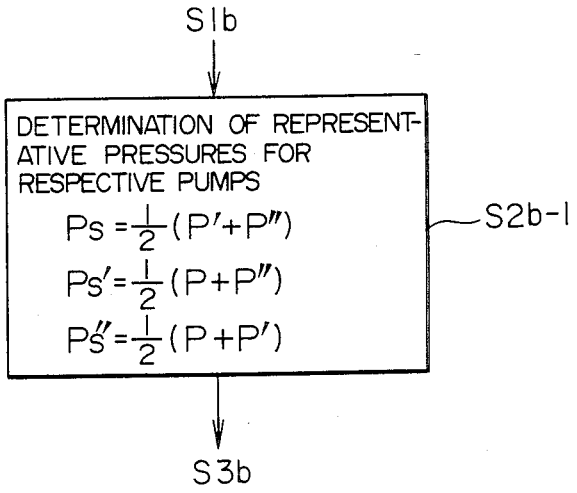
FIG. 13 shows a part of a flow chart illustrating another example of a method of determining the representative pressure in the process shown in FIGS. 11(*a*) and 11(*b*)

FIG. 13 is a flow chart showing a modification of a part of the process of this embodiment. In this modification, as shown by Step S2b-1 in FIG. 13, the first computing means computes the mean value of the discharge pressure signals P' and P'' of the second and third hydraulic pumps 1' and 1'' as the first representative pressure Ps, the mean value of the discharge pressure signals P and P″ of the first and third hydraulic pumps 1 and 1″ as the second representative pressure Ps′, and the mean value of the discharge pressure signals P and P′ of the first and second hydraulic pumps 1 and 1′ as the third representative pressure Ps″.

After the completion of this Step S2*b*-1, the process proceeds to Step S3*b* of the process shown in FIG. 11(*a*).

When the load pressure applied to the second hydraulic pump 1′ and that applied to the third hydraulic pump 1″ are different, e.g., when the former is higher and the latter is extremely low, the sum of the loads applied to both hydraulic pumps 1′, 1″ is small as compared with the case where the load pressures applied to both pumps 1′, 1″ are almost equal. In this case, therefore, the first hydraulic pump 1 can share a greater distribution of the input torque. From this point of view, in the modification shown in FIG. 13, as explained above, for example, the mean value of the discharge pressure signals P′ and P″ of the second and the third hydraulic pumps 1′ and 1″ is made as the first representative pressure Ps by the first computing means, so that it is possible to make the first representative pressure Ps small as compared with the embodiment explained in connection with FIG. 9. In consequence, the first input torque control value δ is increased, so that the first input torque T is increased correspondingly. Thus a suitable input torque distribution in response to respective magnitude of loads applied to the hydraulic pumps 1, 1′ and 1″ can be attained, whereby the output power of the engine 14 can be utilized effectively.

Figure 14:
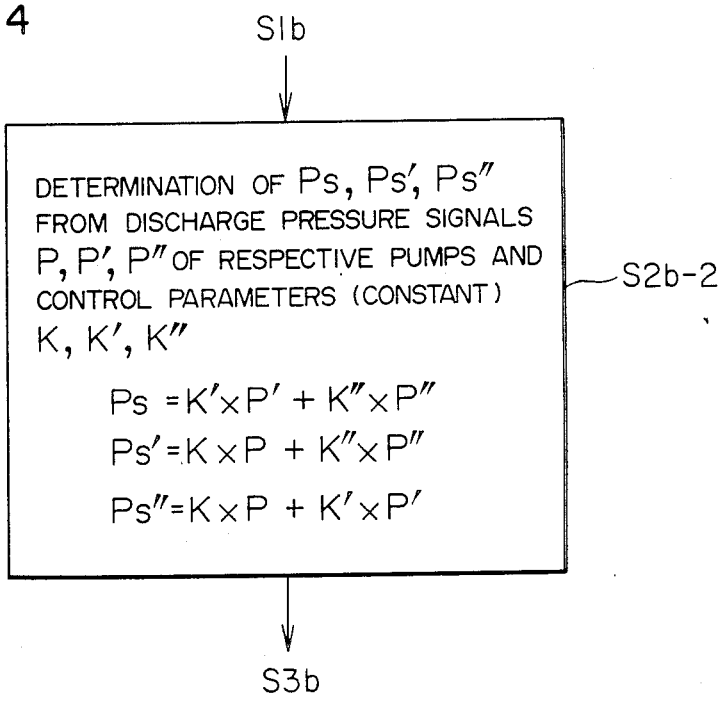
FIG. 14 shows a part of a flow chart illustrating still another example of a method of determining the representative pressure in the process shown in FIGS. 11(*a*) and 11(*b*)

FIG. 14 is a flow chart showing another modification of the part of the process explained in connection with FIG. 11(*a*). In this embodiment, as shown in Step S2*b*-2, the first computing means stores beforehand therein a first control parameter K provided in relation to the discharge capacity of the first hydraulic pump 1, a second control parameter K′ provided in relation to the discharge capacity of the second hydraulic pump 1′, and a third control parameter K″ provided in relation to the discharge capacity of the third hydraulic pump 1″. The first computing means conducts computations for determining the first, second and third representative pressures P, P′ and P″ on the basis of the first, second and third control parameters K, K′ and K″. More specifically, in this modification, the first representative pressure Ps is given as the sum of the product of the second control parameter K′ and the discharge pressure signal P′ of the second hydraulic pump 1′ and the product of the third control parameter K″ and the discharge pressure signal P″ of the third hydraulic pump 1″. Similarly, the second representative pressure Ps′ is determined as the sum of the product of the first control parameter K and the discharge pressure signal P of the first hydraulic pump 1 and the product of the third control parameter K″ and the discharge pressure signal P″ of the third hydraulic pump 1″. Finally, the third representative pressure Ps″ is determined as the sum of the product of the first control parameter K and the discharge pressure signal P of the first hydraulic pump 1 and the product of the second control parameter K′ and the discharge pressure signal P′ of the second hydraulic pump 1′.

Thus, the first computing means is designed to perform the following computations.

$$Ps = K' \times P' + K'' \times P' \quad (13)$$

$$Ps' = K \times P + K'' \times P' \quad (14)$$

$$Ps'' = K \times P + K' \times P' \quad (15)$$

where, K, K′ and K″ are constants.

After the completion of the computation performed by the first computing means in Step S2*b*-2, the process proceeds to Steps S3*b* onwards in FIG. 11(*a*).

This modification is a more general form of the modification explained in connection with FIG. 13. Namely, in the modification explained in connection with FIG. 13, the first representative pressure Ps is determined on an assumption that the discharge pressure signals P′ and P″ of the second and third hydraulic pumps 1′ and 1″ have an equal influence on various works. In contrast, in the modification shown in FIG. 14, the degrees of influence are represented by the control parameters K′, K″. For instance, assuming here that the discharge capacity of the second hydraulic pump 1′ is greater than that of the third pump 1″, there is a difference in the magnitude of loads, namely, input torques of the pumps 1′, 1″ even when the discharge pressures of both pumps are the same and the input torque of the third pump 1″ is smaller than that of the second pump 1′. Therefore, by determining the parameters K′ and K″ as K′=0.7 and K″=0.3, for example, the degree of influence of the discharge pressure of the third hydraulic pump 1″ on the first representative pressure Ps can be decreased as compared with the degree of influence of the discharge pressure of the second hydraulic pump 1′ on the same, so that the first input torque control value 6 can be determined more exactly.

In consequence, the distribution of the input torque of the hydraulic pumps 1, 1′ and 1″ can be determined in accordance with respective magnitude of the actual loads, so that the output power of the engine 14 can be utilized more effectively.

Figure 15:
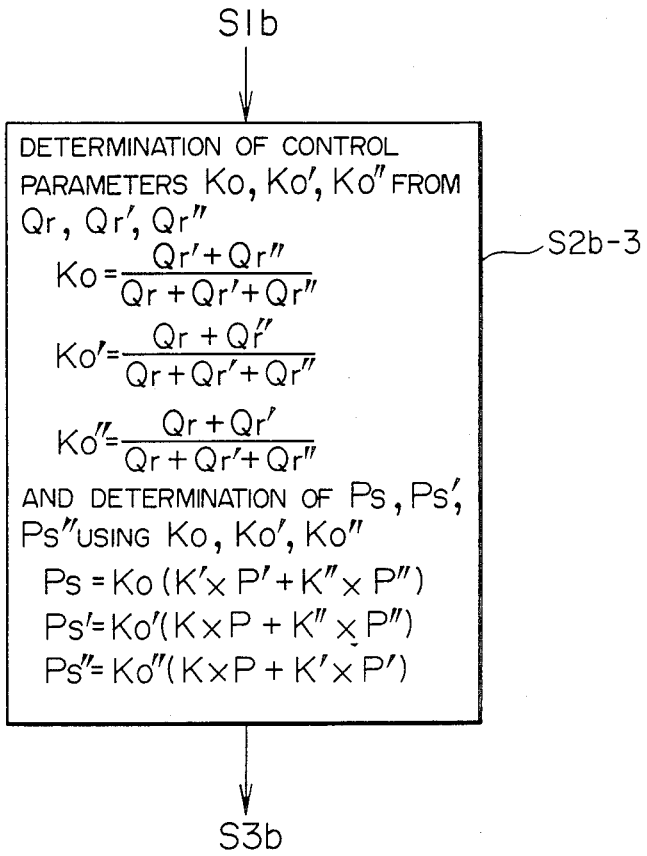
FIG. 15 shows a part of a flow chart illustrating a further example of a method of determining the representative pressure in the process shown in FIGS. 11(*a*) and 11(*b*)

FIG. 15 is a flow chart of still another modification of a part of the process explained in connection with FIG. 9. In this modification, the first control means conducts the following computations in Step S2*b*-3. Namely, the first computing means determines fourth, fifth and sixth control parameters Ko, Ko′ and Ko″ concerning the first, second and third variable displacement hydraulic pumps 1, 1′ and 1″, respectively, in response to the object discharge rate signals Qr, Qr′, Qr″ output by the operation devices 17, 17′, 17″ in accordance with the following formulae.

$$Ko = (Qr' + Qr'')/(Qr + Qr' + Qr'') \quad (16)$$

$$Ko' = (Qr + Qr'')/(Qr + Qr' + Qr'') \quad (17)$$

$$Ko'' = (Qr + Qr')/(Qr + Qr' + Qr'') \quad (18)$$

The first computing means then determines the first, second and third representative pressures Ps, Ps′ and Ps″ in accordance with the following formulae, from the control parameters Ko, Ko′ and Ko″ determined as above, control parameters K, K′ and K″ explained in connection with FIG. 14, and the signals P, P′ and P″indicative of the discharge pressures of the first, second and third hydraulic pumps 1, 1′ and 1″.

$$Ps = Ko\ (K' \times P' + K'' \times P') \quad (19)$$

$$Ps' = Ko'\ (K \times P + K'' \times P') \quad (21)$$

$$Ps''=Ko''\ (K\times P+K'\times P') \quad (22)$$

After the completion of determination of the representative pressures, the process proceeds to Step S3*b* of the flow chart shown in FIG. 11(*a*).

In this embodiment, the distribution of the input torque applied to the hydraulic pumps 1, 1' and 1'' are controlled in accordance with the magnitude of the object discharge rate signals Qr, Qr' and Qr'' output from the operation devices 17, 17' and 17'' associated with respective hydraulic pumps 1, 1' and 1''. Assuming, that the object discharge rate signal Qr for the first hydraulic pump 1 is greater than the object discharge rate signals Qr' and Qr'' for the second and third hydraulic pumps 1 and 1'', for example, the operator could intend to create a distribution of the input torques T, T' and T'' to these hydraulic pumps 1, 1' and 1'' such as to meet the following condition.

$$T>T',\ T''$$

It is, therefore, desirable that the pump input torque control values δ, δ' and δ'' be determined to meet the following condition.

$$\delta>\delta',\ \delta''$$

This can be achieved by the earlier part of the computation in the Step S2*b*-3 performed by the first computing means, as will be understood from the following explanation concerning, for example, the first hydraulic pump 1.

The fourth parameter Ko for the first hydraulic pump 1 is given by $Ko=(Qr'+Qr'')/(Qr+Qr'+Qr'')$. Therefore, when the object discharge rate signals Qr', Qr'' are smaller than the object discharge rate signal Qr for the first hydraulic pump 1, the value of the parameter Ko becomes small, so that the first representative pressure Ps, which is determined in the later part of the computation performed by the first computating means as $Ps=Ko\ (K'\times P'+K''\times P'')$ becomes smaller than that in the case of the modification shown in FIG. 14. On the other hand, the second and third representative pressures Ps' and Ps'' are increased. As a result, the first hydraulic pump 1 shares a greater distribution of the output of the engine 14 than the second and third hydraulic pumps 1' and 1'', whereby torques are effectively distributed to all the hydraulic pumps 1, 1' and 1''.

In this modification, the determination of the control parameters Ko, Ko' and Ko'' employs the steps of determining $(Qr+Qr'+Qr'')$, as will be seen from formulae (16), (17) and (18). This value $(Qr+Qr'+Qr'')$ may be beforehand substituted by a suitable constant.

Figure 16:
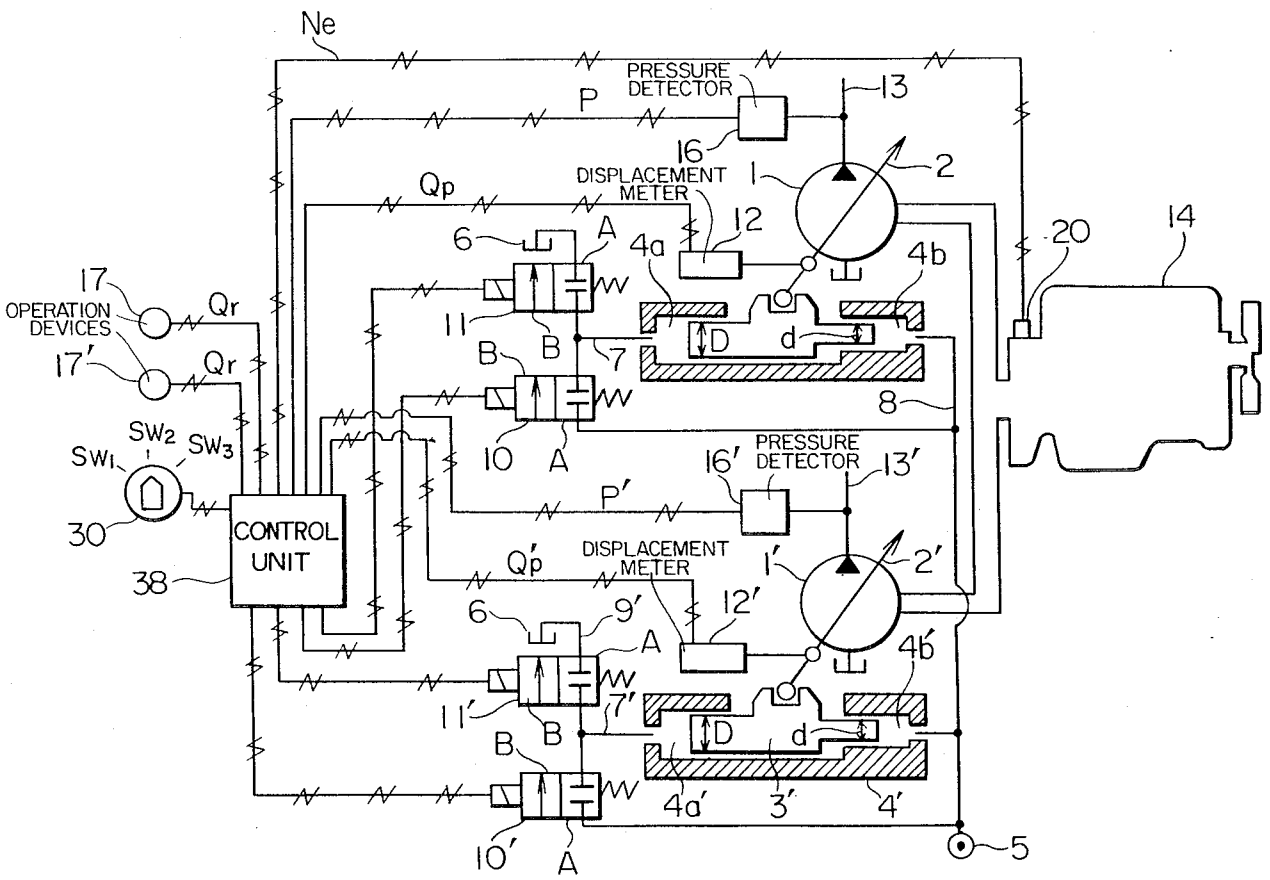
FIG. 16 is a circuit diagram of still another embodiment of a control system in accordance with the present invention.

Still another embodiment will be described hereinafter with reference to FIG. 16. In this drawing, the same reference numerals are used to denote the same parts as those appearing in FIG. 1, and detailed description of such parts is omitted.

The control system of this embodiment has an instructing means, namely, switch 30 which is connected to a control device 38 and adapted to give an instruction for selecting one of a plurality of pump input power control modes such as engine speed detecting type total power control mode, hydraulic pressure detecting type total power control mode and independent control type power control mode. The switch 30 has, for example, three positions SW1, SW2 and SW3. As will be explained later, when the switch 30 is in the position SW1, the control of the pump input power is conducted in the engine speed detecting type total power control mode. Similarly, the control is conducted in the hydraulic pressure detecting type total power control mode and independent control type power control mode, respectively, when the switch 30 is in the positions SW2 and SW3.

Figure 17:
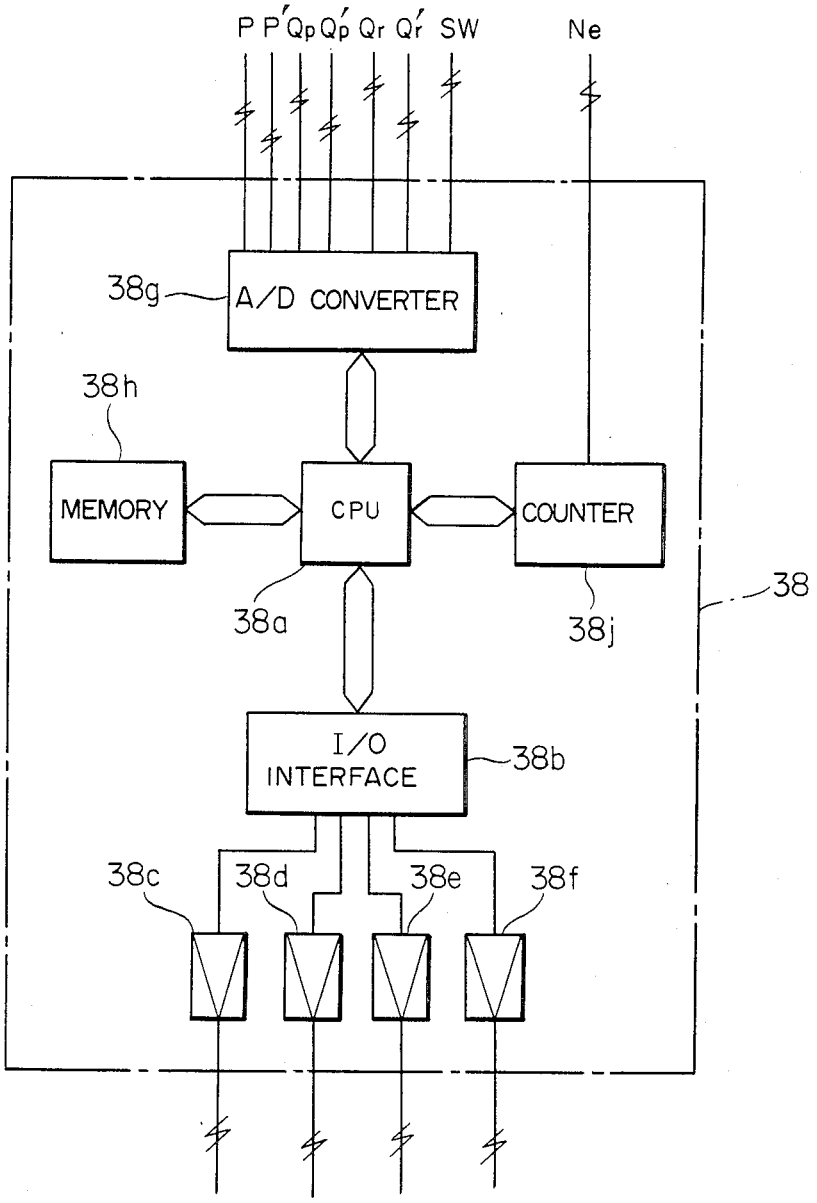
FIG. 17 is an illustration of a control unit incorporated in the control system shown in FIG. 16.

As will be seen from FIG. 17, a control unit 38, which includes a microcomputer and constitutes a critical portion of the pump input power control system of the present invention, comprises a central processing unit 38*a*, and I/O interface 38*b* for output, amplifiers 38*c*, 38*d*, 38*e* and 38*f* respectively connected to the solenoid valves 10, 11, 10' and 11', a memory 38*h* for storing the program of the control process, an A/D converter 38*g* for converting analog signals including the discharge rate control signals Qp, Qp' derived from the displacement meters 12, 12', discharge pressure signals P, P' derived from the pressure detectors 16, 16', the object discharge rate signals Qr, Qr' derived from the operation devices 17, 17', and the instruction signal SW from the switch 30 into respective digital signals, and a counter 38*j* for detecting the pulses from the speed detector 20 and for measuring the interval of the pulses.

The control unit 38 is designed to suitably compute, in accordance with the instruction signal SW given by the switch 30 and on the basis of the control process program stored in the memory 38*h* the object discharge rates Qps, Qps' of the variable displacement pumps 1, 1' and to finally output the command signals Qo, Qo', upon receipt of various signals including the discharge rate signals Qp, Qp' from the displacement meters 12, 12', discharge pressure signals P, P' from the pressure detectors 16, 16', object discharge rate signals Qr, Qr' from the operation devices 17, 17', and rotational speed Ne which is obtained through measurement of the pulse interval performed by the counter 38*j* which counts the pulses derived from the speed detector 20.

More specifically, the memory 38*h* and the central processing unit 38*a* of the control unit 38 have, in addition to the first, second, third and fourth computing means explained in connection with the embodiment shown in FIG. 1, first setting means which presets a predetermined constant input torque control value D concerning the total of the input torques of the hydraulic pumps 1 and 1', second setting means which presets a constant input torque K for each of the hydraulic pumps 1 and 1' and the instructing means 30 for giving an instruction for selecting one of a plurality of pump input power control modes, and are structured such that one of the input torque value δN determined by the fourth computing means and the predetermined constant input torque control value D set in the first setting means is selected in accordance with the control mode selected by the instruction means 30 and used in the computation performed by the first computing means, and at the same time, either one of the input torques values T, T' determined by the second computing means and the predetermined constant input torque value K set in the second setting means is selected in accordance with the control mode selected by the instruction means 30 and is used in the computation performed by the third computing means.

The procedure of the control performed by the control unit 38 of the described embodiment will be explained in connection with FIG. 18.

In Step S1*c*, the central processing unit 38*a* reads various signals representing the state amounts including the discharge pressure signals P, P' from the pressure detectors 16, 16' discharge rate control signals Qp, Qp' from the displacement meters 12, 12', object discharge rate signals Qr, Qr' from the operation devices 17, 17', rotational speed Ne of the engine 14 obtained by the counter 38*j* from the output of the rotational speed detector 20, and the position signal SW from the switch 30.

Then, the process proceeds to Step S2*c* in which the position selected by the switch 30 is determined in accordance with the position signal SW from the switch 30. When the selected position is determined to be SW1, the process proceeds to Step S3*c* and then follows Steps S4*c*, S5*c*, S6*c*, S7*c* and S8*c*. The contents of Steps S3*c* to S8*c* are materially the same as those of Steps S2*a* to S8*a* in the embodiment shown in FIG. 1 and explained in connection with FIGS. 3 to 6, so that detailed description thereof is omitted.

In this case, the discharge rate of each hydraulic pump is controlled in accordance with the detected rotational speed of the engine 14 and also with the discharge pressure of and the own discharge pressure of the other hydraulic pump, as in the case of the first embodiment. It is, therefore, possible to obtain the same advantages as the first embodiment, i.e., elimination of hunting, independent control of discharge rates and full use of the power of the engine. Furthermore, this embodiment can perform the engine speed detecting type total power control capable of controlling in accordance with actual change in the output power of the engine with a stable performance. This control mode is specifically useful when it is desired to perform a work making full use of the engine power, for example, such as heavy-duty digging operation by a hydraulic shovel.

Figure 18:
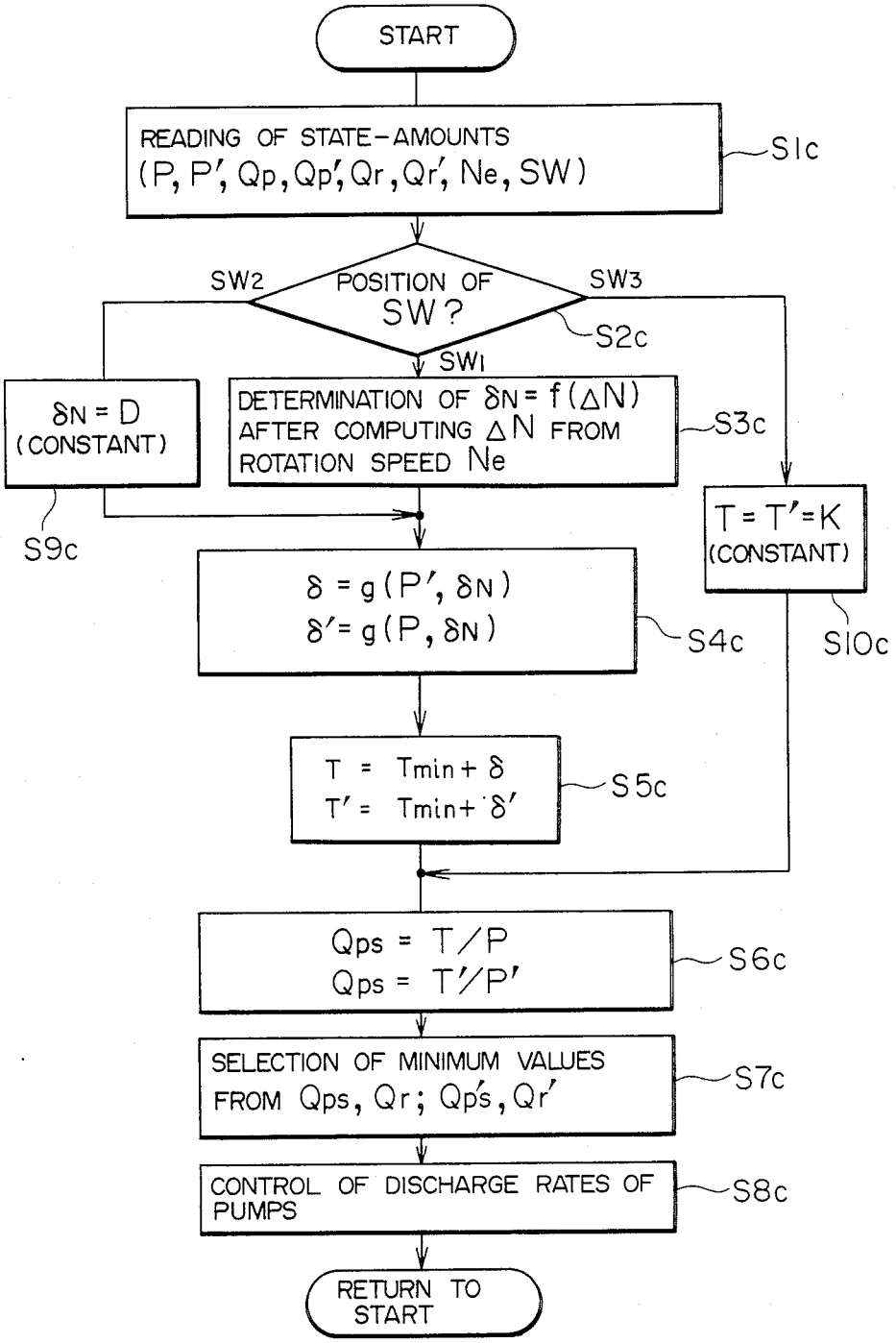
FIG. 18 is a flow chart showing the control process performed by the control unit shown in FIG. 16.

If the position signal output from the switch 30 is determined to be SW2 in Step S2*c* of the flow chart shown in FIG. 18, the process proceeds to Step S9*c* in which the following computation is conducted.

$$\delta N = D \tag{15}$$

where, D is a predetermined constant.

Then, Steps S4*c*, S5*c*, S6*c*, S7*c* and S8*c* are executed.

In this case, since the input torque control value δN concerning the total of the input torques of both hydraulic pumps 1, 1' is beforehand set at a constant value D, it is possible to conduct the hydraulic pressure detecting type total power control, in which the total of the input powers of the hydraulic pumps 1 and 1' does not exceed the output power of the engine 14. Although this control mode cannot conduct control in response to the actual output power of the engine 14, it offers the same advantages as the embodiment explained in connection with FIG. 1, i.e., elimination of hunting, independent control of discharge rates, and full use of the engine output power. This control mode is suitable for use in light-duty work in town areas in which change of the sound by the engine is not desired.

When the position signal from the switch 30 is determined to be SW3 in Step S2*c* shown in FIG. 18, the process proceeds to Step S10*c* in which the following computation is conducted.

$$T = T' = K$$

where, K is a predetermined constant representing the input power of each of the hydraulic pumps 1, 1'.

Then, the process proceeds to Step S6*c*, in which the object discharge rates Qps and Qps' for the first and the second hydraulic pumps 1 and 1' are determined, using the input torque T, T' obtained by the formula (16). The process then proceeds to Steps S7*c* and S8*c*.

In this case, therefore, it is possible to conduct the independent control type power control in which the levels of the input powers to the hydraulic pumps 1, 1' are controlled independently from the input power constant K given for the hydraulic pumps 1, 1' and the discharge pressure signals P, P' concerning respective hydraulic pumps.

This control mode is effective particularly in the case where it is highly desirable that the discharge rate of each pump is not affected by the change in the discharge rate of the other pump. Namely, this control mode is suitably used in such kinds of work which require constant working speed while the power required is not so large, e.g., digging of slope face conducted by a hydraulic shovel.

As will be understood from the foregoing, according to the described embodiment, input power to each hydraulic pump is controlled in response to the speed deviation between the object speed and the actual speed of the engine, and the discharge pressure of the other pump. In addition, instruction enables the user to select the control mode from a plurality of control modes including engine speed detecting type total power control mode in which the levels of input power of the hydraulic pumps are controlled in response to the speed deviation of the engine, hydraulic pressure detecting type total power control mode in which the levels of the power input to the hydraulic pumps are controlled in response to the discharge pressures of the pumps such that each input power does not exceed a predetermined output of the engine, and independent control type power control mode in which the discharge rates are controlled from the discharge pressures of the respective pumps in such a manner that the hydraulic pumps produce predetermined levels of output power. It is, therefore, possible to operate the hydraulic apparatus by selecting the control mode which is most suitable for the characteristics of the work to be conducted.

What is claimed is:

1. A control system for controlling input power to hydraulic pumps of a hydraulic system including a prime mover, a plurality of variable displacement hydraulic pumps driven by said primer mover and operation devices for respectively varying displacement volumes of said plurality of hydraulic pumps, said control system comprising:

rotational detecting means for detecting actual rotational speed of said prime mover;

pressure detecting means for detecting discharge pressure of each of said plurality of hydraulic pumps;

a control unit which includes first computing means for determining, for said plurality of hydraulic pumps, respective input torque control values concerning input torque distribution on the basis of a respective representative pressure, said respective representative pressure being obtained on the basis of discharge pressure of the other hydraulic pumps of said plurality of hydraulic pumps detected by said pressure detecting means, second computing means for determining, for said plurality of hydraulic pumps, respective input torque on the basis of respective input torque control values concerning input torque distribution determined by said first computing means, third computing means for determining, for said plurality of hydraulic pumps, respective object displacement volume signals from respective input torque determined by said second computing means and respective discharge pressure detected by said pressure detecting means, selecting means for comparing said respective object displacement volume signals determined by said third computing means and respective displacement volume signals determined by said operation devices to select respective smaller displacement volume signals; and control means for controlling an inclined angle of a swash plate of each of said plurality of hydraulic pumps in accordance with respective displacement volume signals selected by said selecting means.

2. A control system according to claim 1, wherein said first computing means is adapted to determine said input torque control values concerning input torque distribution on the basis of a first functional relation which is determined such that the input torque control values concerning input torque distribution decrease as the representative pressure increases.

3. A control system according to claim 1, wherein said second computing means is adapted to determine said input torque for said plurality of hydraulic pumps by adding said respective input torque control values concerning input torque distribution to minimum input torque which are respectively predetermined for said plurality of hydraulic pumps.

4. A control system according to claim 1, wherein said first computing means is adapted to determine said input torque control values concerning input torque distribution on the basis of a third functional relation which is determined such that said input torque control values concerning input torque distribution decrease as said representative pressure increases and also said input torque control values concerning input torque distribution decrease as said input torque control value concerning total summation of input torque decreases.

5. A control system according to claim 1, wherein said control unit further comprises fourth computing means for determining an input torque control value concerning total summation of input torque from a deviation between an actual rotational speed detected by said rotational speed detecting means and a predetermined object rotational speed of said prime mover and said first computing means is adapted to determine said respective input torque control values concerning input torque distribution from said respective representative pressure and said input torque control value concerning total summation of input torque determined by said fourth computing means.

6. A control system according to claim 5, wherein said fourth computing means is adapted to determine said input torque control value concerning total summation of input torque on the basis of a second functional relation which is determined such that the input torque control value concerning total summation of input torque decreases as said deviation increases when the actual rotational speed of said prime mover is smaller than said predetermined object rotational speed of said prime mover.

7. A control system according to claim 5, wherein said control system further includes a selector for selecting one of a plurality of control modes for controlling input power to said hydraulic pumps including a hydraulic pressure detecting type total power control mode, and said control unit further includes a memory in which a constant input torque control value concerning total summation of input torque with respect to said plurality of hydraulic pumps is stored beforehand and wherein when the hydraulic pressure detecting type total power control mode is selected by said selector, one of said input torque control value concerning total summation of input torque determined by said fourth computing means and said constant input torque control value concerning total summation of input torque stored in said first memory is selected to be used in the determination of said respective input torque control values concerning input torque distribution in said first computing means.

8. A control system according to claim 5, wherein said control system further includes a selector for selecting one of a plurality of control modes for controlling input power to said hydraulic pumps including an independent control type total power control mode, and said control unit further includes a memory in which a constant input torque with respect to said plurality of hydraulic pumps is stored beforehand, and wherein when the independent control type total power control mode is selected by said selector, one of said input torque determined by said second computing means and said constant input torque control value concerning total summation of input torque control value concerning total summation of input torque stored in said second memory is selected to be used in the determination of said respective object displacement volume signals in said third computing means.

9. A control system according to claim 5, wherein said control system further includes a selector for selecting one of a plurality of control modes for controlling input power to said hydraulic pumps including a hydraulic pressure detecting type total power control mode and an independent control type total power control mode, and said control unit further includes a first memory in which a constant input torque control value concerning total summation of input torque with respect to said plurality of hydraulic pumps is stored beforehand and a second memory in which a constant input torque with respect to said plurality of hydraulic pumps is stored beforehand, and wherein when the hydraulic pressure detecting type total power control mode is selected by said selector, one of said input torque control value concerning total summation of input torque determined by said fourth computing means and said constant input torque control value concerning total summation of input torque stored in said first memory is selected to be used in the determination of said respective input torque control values concerning input torque distribution in said first computing means, and wherein when the independent control type total power control mode is selected by said selector, one of said input torque determined by said second computing means and said constant input torque control value concerning total summation of input torque control value concerning total summation of input torque stored in said second memory is elected to be used in the determination of said respective object displacement volume signals in said third computing means.

10. A control system according to claim 1, wherein said plurality of hydraulic pumps include a first hydraulic pump and a second hydraulic pump, and wherein said first computing means is adapted to determine a first input torque control value concerning input torque distribution for said first hydraulic pump from a first representative pressure which is determined on the basis of the discharge pressure of said second hydraulic pump detected by said pressure detecting means and a second input torque control value concerning input torque distribution for said second hydraulic pump from a second representative pressure which is determined on the basis of the discharge pressure of the said first hydraulic pump detected by said pressure detecting means, and wherein said second computing means is adapted to determine a first input torque for said first hydraulic pump on the basis of said first input torque control value concerning input torque distribution determined by said first computing means and a second input torque for said second hydraulic pump on the basis of said second input torque control value concerning input torque distribution determined by said first computing means, and wherein said third computing means is adapted to determine an object discharge rate for said first hydraulic pump from said first input torque determined by said second computing means and the discharge pressure of said first hydraulic pump detected by said pressure detecting means and an object discharge rate for said second hydraulic pump from said second input torque determined by said second computing means and the discharge pressure of said second hydraulic pump detected by said pressure detecting means.

11. A control system according to claim 10, wherein said first computing means is adapted to determine the discharge pressure of said second hydraulic pump as said representative pressure for said first hydraulic pump and the discharge pressure of said first hydraulic pump as said representative pressure for said second hydraulic pump.

12. A control system according to claim 10, wherein said first computing means has a first control parameter and a second control parameter stored therein beforehand, said first and second control parameters being respectively determined in correspondence to discharge capacities of said first and second hydraulic pumps and includes a fifth computing means for making said first representative pressure to be a product of said second control parameter and the discharge pressure of said second hydraulic pump and for making said second representative pressure to be a product of said first control parameter and the discharge pressure of said first hydraulic pump.

13. A control system according to claim 10, wherein said first computing means includes a fifth computing means for determining said first and second representative pressures from the following formulae, respectively, $$Ps = KoP'$$

$$Ps = Ko'P$$

$$Ko = Qr/(Qr+Qr')$$

$$Ko' = Qr/(Qr+Qr');$$

where

Ps: first representative pressure

Ps': second representative pressure

Ko: third control parameter

Ko': fourth control parameter

Qr: first command value of the operation device for the first hydraulic pump

Qr': second command value of the operation device for the second hydraulic pump.

14. A control system according to claim 10, wherein said first computing means has a first control parameter and a second control parameter stored therein beforehand, said first and second control parameters being respectively determined in correspondence to discharge capacities of said first and second hydraulic pumps and said first computing means includes a fifth computing means for determining said first and second representative pressure from the following formulae, respectively, $$Ps = KoK'P'$$

$$Ps' = Ko'KP$$

$$Ko' = Qr/(Qr+Qr')$$

$$Ko = Qr'/(Qr+Qr');$$

where

Ps: first representative pressure

Ps': second representative pressure

Ko: third control parameter

Ko': fourth control parameter

K: first control parameter

K': second control parameter

Qr: first command value of the operation device for the first hydraulic pump

Qr': second command value of the operation device for the second hydraulic pump.

15. A control system according to claim 1, wherein said plurality of hydraulic pumps include a first hydraulic pump, a second hydraulic pump and a third hydraulic pump, and wherein said first computing means of said control unit includes fifth computing means for determining a first representative pressure for said first hydraulic pump on the basis of the discharge pressure of said second and third hydraulic pump detected by said pressure detecting means, a second representative pressure for said second hydraulic pump on the basis of the discharge pressure of said first and third hydraulic pump detected by said pressure detecting means and a third representative pressure for said third hydraulic pump on the basis of the discharge pressure of said first and second pump detected by said pressure detecting means and sixth computing means for determining first, second and third input torque control values concerning input torque distribution respectively for said first, second and third hydraulic pumps on the basis of the respective first, second and third representative pressures determined by said fifth computing means, and wherein said second computing means of said control unit is adapted to determine first, second and third input torques respectively for said first, second and third hydraulic pumps on the basis of respective ones of said first, second and third input torque control values concerning input distribution determined by said first computing means, and wherein said third computing means is adapted to determine first, second and third object discharge rates respectively for said first, second and third hydraulic pumps from said first input torque determined by said second computing means and the discharge pressure of said first hydraulic pump, said second input torque determined by said second computing means and the discharge pressure of said second hydraulic pump, and said third input torque determined by said second computing means and the discharge pressure of said third hydraulic pressure, respectively.

16. A control system according to claim 15, wherein said fifth computing means is adapted to make a greater one of the discharge pressure of said second and third hydraulic pumps to be said first representative pressure for said first hydraulic pump, a greater one of the discharge pressure of said first and third hydraulic pumps to be said second representative pressure for said second hydraulic pump and a greater one of the discharge pressure of said first and second hydraulic pumps to be said third representative pressure for said third hydraulic pump.

17. A control system according to claim 15, wherein said fifth computing means is adapted to make a means value of the discharged pressure of said second and third hydraulic pumps to be said first representative pressure for said first hydraulic pump, a means value of the discharge pressure of said first and third hydraulic pumps to be said second representative pressure for said second hydraulic pump and a mean value of the discharge pressure of said first and second hydraulic pumps to be said third representative pressure for said third hydraulic pump.

18. A control system according to claim 15, wherein said fifth computing means has first, second and third control parameters stored therein beforehand, said first, second and third control parameters being respectively determined in correspondence to discharge capacities of said first, second and third hydraulic pumps and said fifth computing means is adapted to determine said first, second and third representative pressures from the following formulae, respectively, $$Ps'=K'P+K''P'$$

$$Ps'=KP+K''P'$$

$$Ps''=KP+K'P$$

where

Ps: the first representative pressure

Ps': the second representative pressure

Ps'': the third representative pressure

K: the first control parameter

K': the second control parameter

K'': the third control parameter

P: the discharge pressure of the first hydraulic pump

P': the discharge pressure of the second hydraulic pump

P'': the discharge pressure of the third hydraulic pump.

19. A control system according to claim 15, wherein said fifth computing means is adapted to determine a fourth, a fifth and a sixth control parameters and said first, second and third representative pressures from the following formulae, respectively, $$Ps=Ko(P'+P'')$$

$$Ps'=Ko'(P+P'')$$

$$Ps''=Ko''(P+P')$$

$$Ko=(Qr'+Qr'')/(Qr+Qr'+Qr'')$$

$$Ko'=(Qr+Qr'')/(Qr+Qr'+Qr'')$$

$$Ko''=(Qr+Qr')/(Qr+Qr'+Qr'');$$

where

Qr: the discharge rate of the first hydraulic pump

Qr': the discharge rate of the second hydraulic pump

Qr'': the discharge rae of the third hydraulic pump

Ko: the fourth control parameter

Ko': the fifth control parameter

Ko'': the sixth control parameter

Ps: the first representative pressure

Ps': the second representative pressure

Ps'': the third representative pressure.

20. A control system according to claim 15, wherein said fifth computing means has a first, a second and a third control parameters stored therein beforehand, said first, second and third control parameters being respectively determined in correspondence to discharge capacities of said first, second and third hydraulic pumps and said fifth computing means is adapted to determine a fourth, a fifth and a sixth control parameters and said first, second and third representative pressure from the following formulae, respectively, $$Ko=(Qr'+Qr'')/(Qr+Qr'+Qr'')$$

$$Ko'=(Qr+Qr'')/(Qr+Qr'+Qr'')$$

$$Ko''=(Qr+Qr')/(Qr+Qr'+Qr'')$$

$$Ps=Ko(K'P'+K''P'')$$

$$Ps'=Ko'(KP+K''P'')$$

$$Ps''=Ko''(KP+K'P');$$

where

Qr: the discharge rate of the first hydraulic pump

Qr': the discharge rate of the second hydraulic pump
Qr'': the discharge rate of the third hydraulic pump
Ko: the fourth control parameter
Ko': the fifth control parameter
Ko'': the sixth control parameter
Ps: the first representative pressure
Ps': the second representative pressure
Ps'': the third representative pressure.

* * * * *